US009351365B2

(12) United States Patent
Saes et al.

(10) Patent No.: US 9,351,365 B2
(45) Date of Patent: May 24, 2016

(54) CONTROL UNIT FOR LED ASSEMBLY AND LIGHTING SYSTEM

(75) Inventors: Marc Saes, Eindhoven (NL); Petrus Johannes Maria Welten, Oss (NL)

(73) Assignee: ELDOLAB HOLDING B.V., Son en Breugel (NL)

( * ) Notice: Subject to any disclaimer, the term of this patent is extended or adjusted under 35 U.S.C. 154(b) by 788 days.

(21) Appl. No.: 13/390,581

(22) PCT Filed: Aug. 17, 2010

(86) PCT No.: PCT/NL2010/050516

§ 371 (c)(1),
(2), (4) Date: Apr. 30, 2012

(87) PCT Pub. No.: WO2011/021932

PCT Pub. Date: Feb. 24, 2011

(65) Prior Publication Data

US 2012/0223649 A1 Sep. 6, 2012

Related U.S. Application Data

(63) Continuation-in-part of application No. PCT/NL2010/000065, filed on Apr. 9, 2010.

(60) Provisional application No. 61/234,790, filed on Aug. 18, 2009.

(51) Int. Cl.
*H05B 37/00* (2006.01)
*H05B 33/08* (2006.01)

(52) U.S. Cl.
CPC ..... *H05B 33/083* (2013.01); *H05B 33/0818* (2013.01)

(58) Field of Classification Search
CPC ..... H05B 33/00; H05B 33/08; H05B 33/083; H05B 37/00
USPC ..... 315/186, 224
See application file for complete search history.

(56) References Cited

U.S. PATENT DOCUMENTS

| | | | | |
|---|---|---|---|---|
| 7,671,575 | B1 * | 3/2010 | Suzuki et al. | 323/285 |
| 2006/0038803 | A1 * | 2/2006 | Miller et al. | 345/204 |
| 2007/0188425 | A1 | 8/2007 | Saccomanno | |
| 2007/0262724 | A1 * | 11/2007 | Mednik et al. | 315/125 |

(Continued)

FOREIGN PATENT DOCUMENTS

| | | | |
|---|---|---|---|
| WO | WO 2006107199 | A2 | 10/2006 |
| WO | WO 200714171 | A1 | 12/2007 |

(Continued)

*Primary Examiner* — Tuyet Vo
*Assistant Examiner* — Henry Luong
(74) *Attorney, Agent, or Firm* — Browdy and Neimark, P.L.L.C.

(57) ABSTRACT

A lighting system comprising an LED assembly that comprises a first and second LED unit said LED units being serial connected is described. The system comprises; □ a switched mode power supply for powering the LED assembly; □ a control unit for controlling the LED assembly the control unit being arranged to: □ receive an input signal representing a desired output characteristic of the LED assembly, □ determine a first and second duty cycle for the respective first and second LED units associated with a nominal current of the switched mode power supply, for providing the desired output characteristic, □ determine the largest of the first and second duty cycles for respective LED units, □ determine a reduced current based on at least the largest of the duty cycles, □ adjust the first and second duty cycle for respective LED units based on the reduced current or the largest of the duty cycles, □ provide output data for the LED assembly and the switched mode power supply based on the adjusted first and second duty cycles and the reduced current. The LED assembly of the system further comprises a capacitor connectable in parallel to the first and second LED units by operating a switch connected in series with the capacitor and wherein the control unit is arranged to control the switch based on at least one of the reduced current and the input signal.

16 Claims, 21 Drawing Sheets

(56) References Cited

U.S. PATENT DOCUMENTS

| | | | | |
|---|---|---|---|---|
| 2008/0116818 | A1 | 5/2008 | Shteynberg et al. | |
| 2011/0109247 | A1 * | 5/2011 | Hoogzaad et al. | 315/294 |
| 2011/0115412 | A1 * | 5/2011 | Welten | H05B 33/0815 315/307 |

FOREIGN PATENT DOCUMENTS

| | | | |
|---|---|---|---|
| WO | WO 2009013676 | A2 | 1/2009 |
| WO | WO 2009029553 | A2 | 3/2009 |
| WO | WO 2010004475 | A1 | 1/2010 |

* cited by examiner

CONTROL UNIT FOR LED ASSEMBLY AND LIGHTING SYSTEM

TECHNICAL FIELD

The present invention relates to lighting systems using Light Emitting Diodes.

BACKGROUND ART

At present, in architectural and entertainment lighting applications more and more solid state lighting based on Light Emitting Diodes (LED) is used. LED's or LED units have several advantages over incandescent lighting, such as higher power to light conversion efficiency, faster and more precise lighting intensity and color control. In order to achieve this precise control of intensity and color from very dim to very bright light output, it is necessary to have accurate control of the forward current flowing through the LED's.

In order to provide said forward current through the LED or LED's, a converter (or a regulator such as a linear regulator) can be used. Examples of such converters are Buck, Boost or Buck-Boost converters. Such converters are also referred to as switch mode power sources. Such power sources enable the provision of a substantially constant current to the LED unit. When such a LED unit comprises LED's of different color, the resulting color provided by the LED unit can be modified by changing the intensity of the different LED's of the unit. This is, in general, done by changing the duty cycles of the different LED's. Operating the LED's at a duty cycle less than 100%, can be achieved by selectively (over time) providing a current to the LED's, i.e. providing the LED's with current pulses rather than with a continuous current. As more and more conventional lighting systems such as halogen lighting or light bulbs are replaced by lighting systems using Light Emitting Diodes, it is important to operate such a lighting system efficiently in order to minimize the power consumption associated with it. In general, a lighting system is applied to operate over a range of illumination (or lighting) conditions (e.g. the brightness of lighting system may be set within a certain range). By merely considering the efficiency of the lighting system at e.g. a nominal operating point rather than over the entire operating range or part of the operating range, the power losses of known lighting systems may be important when operating under certain conditions (e.g. a reduced brightness compared to a nominal brightness).

It is therefore an object of a first aspect of the present invention to improve the efficiency of a lighting system using LED's.

It has been described to drive a plurality of LED's by means of time based modulation techniques, such as pulse width modulation, duty cycle modulation algorithms etc. Thereby, the LED's may be divided in groups, wherein each group of LED's e.g. has its own color of light, each group of LED's being driven by a suitable modulation technique with a certain duty cycle. An example thereof is provided in WO2006107199 A2, wherein LED's or groups of LED's are connected in series, the LED's or groups of LED's each being provided with its own switching device connected in parallel to the group or to each LED. A current source is provided to generate a current through the series connection of LED's or groups of LED's. Closing the parallel switch will bypass the LED or group of LED's so as to switch it off.

At a lower intensity, a change in the intensity by an increase or decrease of the duty cycle becomes relatively larger, the smaller the duty cycle. As an example, assuming a 16 bit duty cycle information, a decrement from FFFF (hexadecimal) to FFFE (hexadecimal) provides percentagewise a small reduction, thus enabling a smooth dimming, while a decrement of for example 0009 to 0008 provides percentagewise a large reduction. This effect may be emphasized by a sensitivity of the human eye, which is commonly assumed to have a logarithmic or similar characteristic. Hence, at low intensity levels and low duty cycles, an increment or decrement in duty cycle will result in a relatively more noticeable change than at large duty cycles. Hence, at low intensities, a possibly less smooth change in intensity can be obtained as compared to more large intensities.

Accordingly, an object of a second aspect of the invention is to provide a higher dimming resolution at lower intensities.

SUMMARY OF THE INVENTION

According to a first aspect of the invention, there is provided lighting system comprising

- an LED assembly that comprises a first and second LED unit said LED units being serial connected;
- a switched mode power supply for powering the LED assembly;
- a control unit for controlling the LED assembly the control unit being arranged to:
  - receive an input signal representing a desired output characteristic of the LED assembly,
  - determine a first and second duty cycle for the respective first and second LED units associated with a nominal current of the switched mode power supply, for providing the desired output characteristic,
  - determine the largest of the first and second duty cycles for respective LED units,
  - determine a reduced current based on at least the largest of the duty cycles,
  - adjust the first and second duty cycle for respective LED units based on the reduced current or the largest of the duty cycles,
  - provide output data for the LED assembly and the switched mode power supply based on the adjusted first and second duty cycles and the reduced current.
- and wherein the LED assembly further comprises a capacitor connectable in parallel to the first and second LED units by operating a switch connected in series with the capacitor and wherein the control unit is arranged to control the switch based on at least one of the reduced current and the input signal.

Within the present invention, a LED unit is understood as comprising one or more light emitting diodes. In case the LED unit comprises more than one light emitting diode, said diodes can either be connected in series or in parallel, or a combination thereof.

A LED assembly is understood as comprising more than one LED unit.

The control unit according to the present invention is arranged to receive an input signal representing a desired characteristic of the LED assembly. Such input signal can e.g. be an analogue signal or a digital signal. Such signal can e.g. be generated by a user interface such as a dimmer or push button. The desired characteristic of the LED assembly can e.g. be defined in any suitable way, e.g. optical or electrical, examples being a desired brightness/intensity or color.

The control unit according to the present invention can be applied to a LED assembly comprising multiple LED units, in particular a LED assembly comprising LED units connected in series. Said serial connection of LED units can e.g. be powered by a switched mode power supply such as a buck converter or a boost converter or any other switching power supply. In use, said power supply can provide a current to the serial connected LED units.

Each of the LED units is individually driven by the control unit, so as to operate the one or more LED's of each unit simultaneously. The control unit according to the present invention is further arranged to determine the required duty cycles of the LED units for obtaining the desired characteristic of the LED assembly, given the nominal current of the power supply. These duty cycles of the LED units can be represented as the percentage or the fraction of time that a current is provided to the LED unit (e.g. 50% or 0.5).

In order to operate at e.g. a reduced brightness, known control units merely reduce the duty cycle of the different LED units of the LED assembly. Thereby, a current level of the switched mode power supply is kept at its nominal level. This may result in a situation were the switched mode power supply, at certain levels of brightness, operates at a relatively low power efficiency. According to the invention, a current (or other relevant output characteristic) of the switched mode power supply is adjusted in such a way that an output current (or other relevant output characteristic) is provided which is adapted to meet the circumstances. As an example, reducing the output power of the LED units according to the state of the art may be achieved by reduction of the duty cycle with which the LED units are driven, while the current is kept at its nominal level. According to the invention however, a value is chosen for the current (or other relevant output characteristic) of the switched mode power supply and for the duty cycle, which results in the desired brightness (or other relevant output characteristic), however, at more power efficient working conditions of the e.g. switched mode power supply and/or other components involved. Due to the serial connection of the LED units, the same current may be applied in order to operate each of the LED units. Therefore, the operating current (or other relevant output characteristic) may be determined, taking into account a value of it as would be required by the different LED units. Thereto, the power supply may be set to such a level so as to provide an output current (or other relevant output characteristic), which has a sufficiently high value in order to be able to drive the LED unit which requires such value. For each of the LED units, a duty cycle is now selected or amended, in order to reflect the changed output current (or other relevant output characteristic) of the switched mode power supply. This may be illustrated by a simple example: Assume that three LED units are driven by the power supply, the LED units being serially connected. Assume that, at nominal operating current of the power supply, a duty cycle for the first, second and third units would be set at 10%, 1% and 1% resp. By reducing the output current of the power supply to e.g. $1/10^{th}$ of its nominal value, and increasing the duty cycles of the units by a factor 10, the same brightness level would be obtained, thereby operating the power supply at a low current which may achieve a more favourable power efficiency thereof. In general, reducing the current (or other relevant output characteristic) of the power supply by a factor N may be combined with an increase of the duty cycle of each of the units by that same factor. The factor N is determined from the largest one of the duty cycles of the LED units. Reducing the output current (or other relevant output characteristic) of the power supply may be performed stepwise or as a continuous value within a certain operating range. In general, the reduced current will be set so as to keep the duty cycle of the LED unit requiring the largest duty cycle to a value below or equal to 100%. Depending on an implementation, a maximum effect may be achieved by reducing the current such that it substantially corresponds to the nominal current multiplied with the largest duty cycle. Thereby, the LED unit requiring the largest duty cycle is then operated at substantially 100% duty cycle. It is noted that the term duty cycle may refer to a periodic part of any type of time period, e.g. continuous time, time slots, etc. 100% duty cycle may thus be interpreted so as to comprise 100% of continuous time or 100% of any (e.g. repetitive) time slot. It can be noted that the steps as performed by the control unit can be performed in any suitable time order. It is for example possible that the step of determining the reduced current based on the at least largest duty cycle may equally applied when the adjusted duty cycles are already determined, e.g. based on the largest duty cycle. When the LED assembly and power supply are thus operated based on the reduced current and adjusted duty cycles, rather than based on the nominal current and the duty cycles associated with this current, an improved efficiency can be observed either with the LED units of the LED assembly or with the power supply, as will be detailed further below.

The control unit as applied in the present invention can e.g. comprise a programmable device such as a microprocessor or microcontroller or another processing unit, the programmable device being programmed with suitable program instructions in order to provide the functionality as described in this document. Further solutions are imaginable too, such as analogue hardware or electronic circuits. The output data provided by the control unit for obtaining the desired characteristic can be in any suitable form e.g. as a data stream on a data bus, a data stream in any digital format, as separate signals for the duty cycle and the switched mode power supply, e.g. Pulse Width Modulation, as an analogue voltage level, or as any other information. The output data may comprise single signals or multiple signals. Where in this document signal or signals are applied, this is to be understood as to comprise any form of output data.

According to a second aspect of the invention, there is provided a control unit for a LED assembly comprising a first and second LED unit, said LED units being serial connected, the LED assembly, in use, being powered by a switched mode power supply, the control unit being arranged to

- receive an input signal representing a desired output characteristic of the LED assembly,
- determine a power supply current of the switched mode power supply from the received input signal,
- determine a first and second duty cycle for the respective first and second LED units from the determined power supply current and the input signal, the combination of duty cycle and power supply current being set for providing the desired output characteristic,
- provide output data for the LED assembly and the switched mode power supply based on the determined first and second duty cycles and the determined power supply current.

Thereby, in addition to the duty cycle dimming as known from the art, a further mechanism for dimming may be made available. Hence, at low intensities, where the resolution of the duty cycle dimming may set a limit to the obtainable brightness resolution, the power supply current may be reduced allowing a larger duty cycle hence allowing a higher brightness resolution. Furthermore, power efficiency may be increased as described above.

A lighting system comprising a LED assembly that comprises a first and second LED unit and the control unit for controlling the LED assembly may further comprise a feedback circuit to feed a signal representative of the power supply current to a feedback input of the switched mode power supply, the feedback circuit comprising a digital potentiometer, the control unit having a control output connected to the digital potentiometer for controlling the power supply current. By using a (microprocessor controllable) digital potentiometer, e.g. in a feedback circuit of an amplifier, in a resistive level shifter, in a resistive attenuator or otherwise, an accurate, fast, low cost control of the current may be obtained, while enabling a convenient interfacing with the control unit.

The power supply current may further be controlled by controlling the power supply current to a first value in a first part of a cycle time and to a second value in a second part of the cycle time, to thereby obtain an effective power supply current between these values, thereby allowing e.g. a further increase in brightness resolution.

According to a further aspect of the invention, there is provided a circuit for driving a LED assembly comprising at least one LED illumination device, the circuit comprising

- a switch,
- an inductor, in a series connection with the switch, the switch to in a conductive state thereof charge the inductor,
- a current measurement element to measure a current flowing through at least one of the inductor and the LED illumination device, the switch, inductor and current measurement element being arranged to establish in operation a series connection with the LED illumination device, the circuit further comprising:

- a reference signal generator for generating a reference signal;
- a comparator to compare a signal representing the current measured by the current measurement element with the reference signal, an output of the comparator being provided to a driving input of the switch for driving the switch, and
- a controller to control an operation of at least one of the reference signal generator and the comparator.

In an embodiment, the circuit according to the invention is provided in a lighting system according to the invention, whereby the controller of the circuit is arranged to control According to a third aspect of the present invention, there is provided a lighting system comprising

- an LED assembly comprising a first LED unit and a capacitor connectable in parallel to the first LED unit by operating a switch connected in series with the capacitor;
- a switched mode power supply for, in use, powering the LED assembly, and
- a control unit comprising:
  - an input port for receiving an input signal;
  - an output port for providing a control signal to the switched mode power supply and the switch, the control unit being arranged to
  - receive an input signal representing a desired output characteristic of the LED assembly,
  - determine a power supply current for the switched mode power supply from the received input signal,
  - provide, via the output port, a power supply control signal to the switched mode power supply to control the switched mode power supply to provide the power supply current to the LED assembly; and
  - provide, via the output port, a switch control signal to control the switch based on at least one of the power supply current and the input signal.

In the lighting system according to the third aspect of the invention, a control unit is provided which enables, similar to the control units according to the first and second aspect of the invention, in addition to the duty cycle dimming as known from the art, a further mechanism for dimming, by modifying the operating current of the switched mode power supply. Hence, at low intensities, where the resolution of the duty cycle dimming may set a limit to the obtainable brightness resolution, the power supply current may be reduced allowing a larger duty cycle hence allowing a higher brightness resolution. Furthermore, power efficiency may be increased as described above. In addition to determining the appropriate duty cycle(s) for the LED unit(s) and the power supply current, the control unit can switch a capacitor in parallel to the LED unit or units. By connecting the capacitor in parallel to the LED unit or units, a current ripple observed on the current through the LED unit or units can be mitigated. In case a comparatively high light output is required, which can e.g. be realised by providing the LED unit or units with a comparatively high current, it is desirable to have the current as smooth as possible. As will be understood by the skilled person, the proper operation of an LED or LED unit could be compromised in case the LED or LED unit is supplied with a high current (e.g. a nominal or maximal current) which includes a comparatively large ripple, e.g. 20-30%. As, in general, the current as provided by a switched mode power supply comprises a current ripple, measures should be taken to mitigate the current ripple in case a comparatively high light output or brightness is required.

In case an LED or LED unit is provided with a current e.g. above its nominal or maximal current (either continuously or temporarily), adverse effects can be observed:

As a first effect, a decrease in lifetime or life-expectancy of the LED or LED unit could occur in case an LED or LED unit is operated above a maximum specified current. When the switched mode power supply provides a current having a significant ripple to the LED or LED unit, the maximum specified current can temporarily be exceeded. Note that this effect may occur regardless the actual duty cycle the LED or LED unit is operating at.

As a second effect, a current having a significant current ripple may cause the LED or LED unit to operate at an elevated temperature which may also adversely affect the life expectancy of the LED or LED unit. In particular, when a comparatively large current including a current ripple is applied in combination with a high duty cycle, the LED or LED unit may operate at temperature levels exceeding a maximum operating temperature.

In the present invention, a current ripple of the current provided to the LED units can be reduced by connecting a capacitor in parallel to the LED unit or units. When connected, the capacitor can be charged by the switched mode power supply and acts as a buffer. The charge or discharge current of the capacitor enables mitigating variations of the current as provided to the LED unit or units. In accordance with the third aspect of the invention, the capacitor can be connected or disconnected in parallel to the LED unit or units by operating a switch which is controlled by the control unit. In accordance with the invention, the control unit can provide, e.g. via an output port of the control unit, a control signal to the switch thereby controlling the operating state (either open or closed) of the switch. The control of the switch can be based on either the power supply current applied or the input signal or both. It has been observed by the inventors that the application of the parallel connected capacitor is preferably applied to reduce an occurring current ripple at high power levels, e.g. the LED unit or units operating at nominal or above nominal current. When a comparatively low light output or brightness is required, i.e. the LED unit or units operating at a reduced current (relative to the nominal current), it has been observed that the application of a parallel capacitor is not required and may even have some adverse effects such as hindering an accurate current pulse shaping. As will be understood by the skilled person, when a LED unit is operated well below the nominal current (e.g. 50% of the nominal current), a current ripple of e.g. 20 or 30% will substantially not affect the proper operation of the LED unit; regardless of the operating duty cycle, nor would it e.g. affect the lifetime of the LED unit. As such, the parallel capacitor is not needed at comparatively low power levels. It should however be noted that, due to the relationship between the instantaneous current through an LED an the brightness of the light produced, a current ripple can affect the average light output of an LED.

The presence of the parallel connected capacitor at comparatively low power levels may even affect the efficiency due to losses in the capacitor or may result in peak-currents due to the charging and discharging of the capacitor. As such, in accordance with the invention, the capacitor can be disconnected by the control unit controlling a switch in series with the capacitor. In general, the operating state of the switch in series with the capacitor can be controlled based on the power requirements/operating conditions of the LED units. As an example, the input signal and/or the applied power supply current can be considered a basis for the power requirements/operating conditions and can thus be applied to determine whether or not to connect the capacitor in parallel to the LED unit or units.

In order to receive the input signal, the control unit of the lighting system is provided with an input port, e.g. a terminal to which a signal can be provided. Similarly, in order to provide control signals for controlling the switched mode power supply to provide the power supply current; and for controlling the switch, the control unit is provided with an output port.

In an embodiment, the lighting system according to the third aspect of the invention comprises a control unit according to the first or second aspect of the invention whereby the control unit is arranged to control the switch connected in series with the capacitor.

In an embodiment, the control unit of the lighting system according to the third aspect of the invention can thus be arranged to apply a current duty cycling as explained in more detail below.

Further, similar to the lighting systems described according to the first and second aspect of the invention, the lighting system can be obtained by providing the first LED unit during assembly of the lighting system. As such, according to the present invention, there is provided a lighting system comprising

- an LED assembly comprising a capacitor connectable in parallel to a first LED unit by operating a switch connected in series with the capacitor;
- a switched mode power supply for, in use, powering the LED assembly, and
- a control unit comprising:
  - an input port for receiving an input signal;
  - an output port for providing a control signal to the switched mode power supply and the switch, the control unit being arranged to
  - receive an input signal representing a desired output characteristic of the LED assembly,
  - determine a power supply current for the switched mode power supply from the received input signal,
  - provide, via the output port, a power supply control signal to the switched mode power supply to control the switched mode power supply to provide the power supply current to the LED assembly; and
  - provide, via the output port, a switch control signal to control the switch based on at least one of the power supply current and the input signal.

In an embodiment, the lighting system comprises a second LED unit wherein the capacitor is connectable in parallel to the first and second LED units by operating the switch.

In case the LED assembly comprises a plurality of LED units, it may be considered to provide each LED unit with a capacitor connectable in parallel to the LED unit by operating a switch connected in series with the capacitor. As such, for each LED unit, it can be decided to either connect the respective capacitor in parallel or not.

The use of a capacitor connectable in parallel to the LED unit, as provided in the lighting system according to the third aspect of the invention, is particularly useful when resonant power converter is used as an SMPS. Such a resonant power converter can be characterised as a converter providing a current having a substantial current ripple, which is due to the switching characteristic. Within the meaning of the present invention, resonant power converters are referred to as converters operating in boundary condition mode or discontinuous condition mode. Operating a power converter or SMPS in either boundary condition mode or discontinuous condition mode is a more efficient way to supply a current to an LED unit. In the so-called boundary conduction mode (also known as critical condition mode), a switch of the power converter is switched off at a predetermined level (e.g. determined from a set-point indicating a desired illumination characteristic), and switched on again at a zero-crossing of the current. Such an operating mode is e.g. described in US 2007/0267978. By operating the power converter in a critical conduction mode, less dissipation occurs in the switch or switches of the power converter, providing an improved overall efficiency. Similar advantages are obtained by operating in discontinuous condition mode. By combining a resonant power converter with the use of a capacitor connectable in parallel to the LED unit, an even further improvement of the efficiency is obtained.

DESCRIPTION

Figure 1:
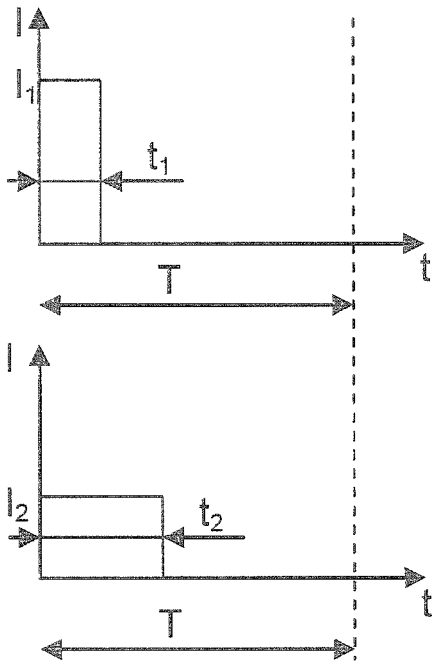
FIG. 1 depicts the situation for a state of the art system in which a low brightness is generated.

In order to obtain a desired characteristic of a lighting system comprising a LED unit, several variables are available for obtaining this characteristic. As an example, when powered by a switched mode power supply such as a buck converter or a resonant power converter, the required characteristic can be obtained by providing a current I to the LED unit having a certain duty cycle. In case the duty cycle required to provide the desired characteristic, the desired characteristic may also be obtained by selecting a smaller current, combined with an increased duty cycle. This is illustrated in FIG. 1. Assuming that, in order to provide a desired characteristic (e.g. a desired brightness), a current $I_1$ is provided with a duty cycle $t_1/T$ (e.g. 25%), see top part of FIG. 1. In case of a linear relationship between the desired characteristic and the current, the desired characteristic may also be achieved by providing a current $I_2=I_1/2$ with a duty cycle $t_2=2*t_1$. In the relationship between the current provided to the LED unit and the characteristic is not linear, a correction may need to be applied to either the current or the duty cycle in order to realise the same desired characteristic, see further on. Providing a current I with a certain duty cycle to a LED unit can be realised in different ways. As an example, when a LED unit is e.g. supplied from a buck converter, a certain duty cycle can be realised by switching the converter resulting in a certain ON time and OFF time. The duty cycle can then be defined as the percentage ON time.

Alternatively, a current I with a certain duty cycle can be realised by providing a substantially constant current I by the power supply, e.g. a buck converter, and controlling a switch provided in parallel to the LED unit. When such switch is closed, the current provided by the converter is redirected from the LED unit to the closed switch. A lighting system according to the present invention that enables both methods of providing a current I to a LED unit is schematically depicted in FIG. 2.

Figure 2:
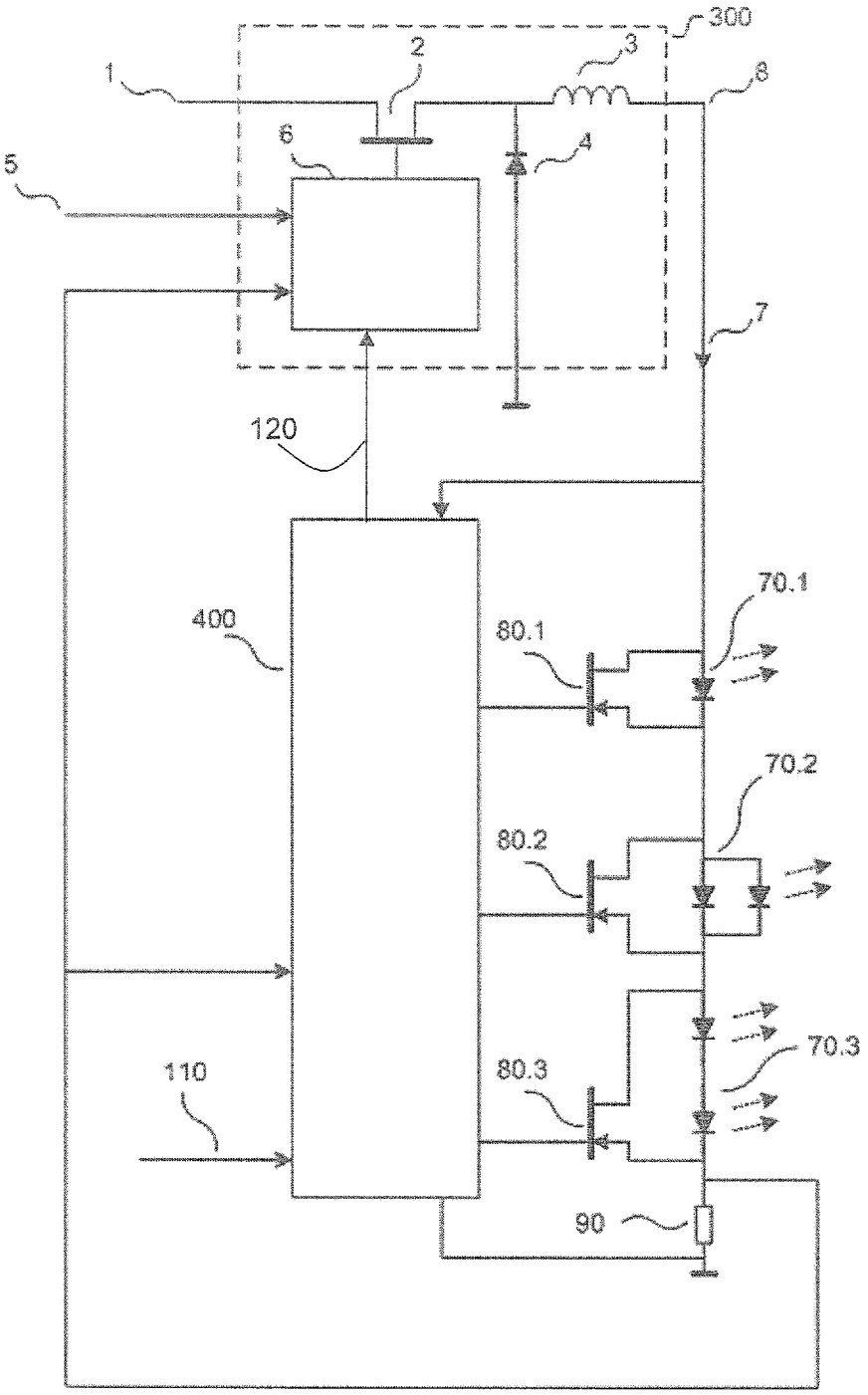
FIG. 2 depicts an embodiment of a lighting system according to the present invention.

FIG. 2 schematically depicts a lighting system comprising a control unit 400 arranged to control a switched mode power supply 300 and a LED assembly comprising three LED units 70.1, 70.2 and 70.3. The LED assembly further comprises switches (e.g. MOSFET's) 80.1, 80.2 and 80.3 associated with each LED unit for controlling the current per LED unit.

In order to provide a desired output characteristic of the LED assembly, each of the LED units can be driven at a certain duty cycle. The control unit 400 is arranged to receive an input signal 110 that may represent a desired characteristic (e.g. a certain brightness or color) of the LED assembly. The power supply 300 is known as a buck converter and comprises a switching element 2, an inductance 3 and a diode 4. A controller 6 controls the switching of the switching element 2, e.g. based on a reference input 5 and a feedback of the LED assembly. A voltage over the resistance 90 of the LED assembly can e.g. be applied as a feedback for the actual current 7 provided by the power supply. The control unit 400 can further be arranged to provide an output signal 120 to the power supply 300 for controlling the output of the power supply. Designated by reference number 1 is the supply voltage of the power supply (e.g. 16 or 24 V), designated by reference number 8 is the output voltage of the power supply which substantially corresponds to the sum of the voltages over the multiple LED units, also referred to as the forward voltage over the LED units.

In accordance with the present invention, the control unit 400 is arranged to provide a control signal to the LED assembly. As such, the switches 80 can be controlled and the different LED units can be arranged to operate at a certain duty cycle.

Figure 3:
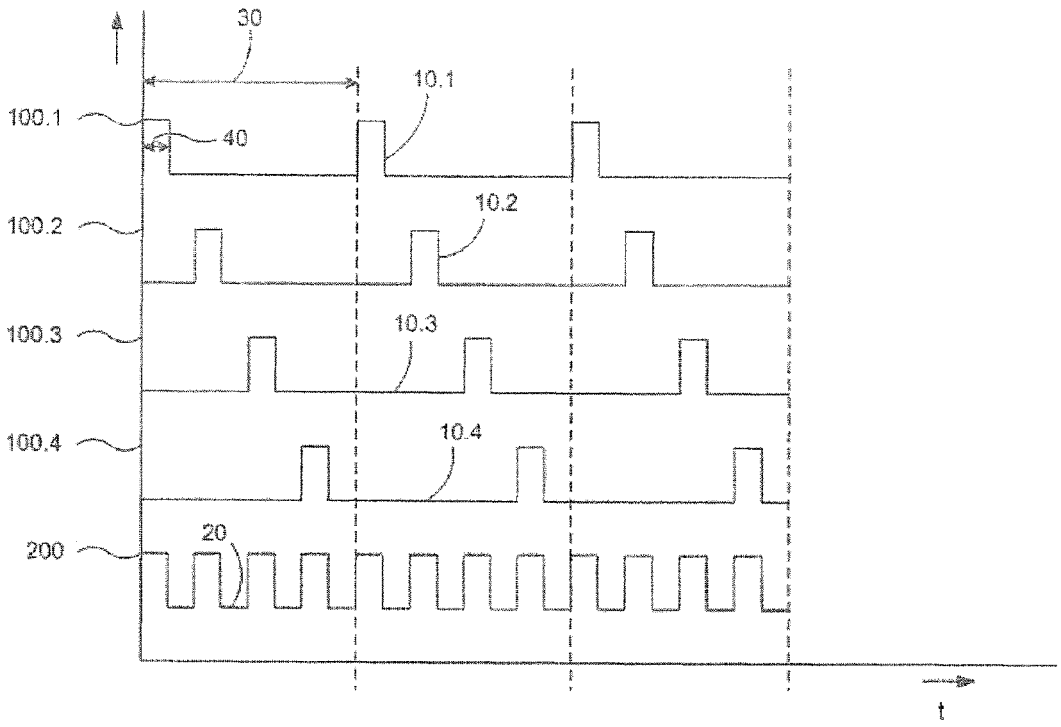
FIG. 3 schematically depicts the duty cycles of a plurality of LED units for a desired characteristic when a nominal current is applied.
Figure 4:
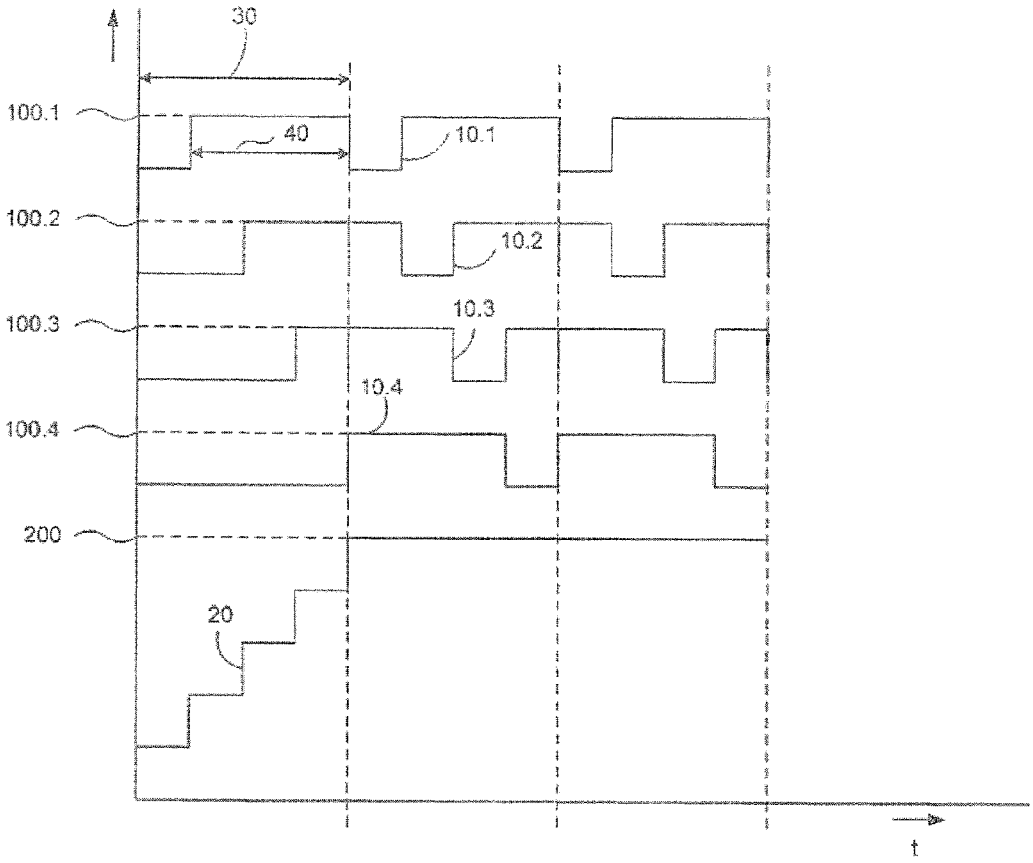
FIG. 4 schematically depicts the adjusted duty cycles of a plurality of LED units for a desired characteristic when a reduced current is applied.

In order to illustrate this, FIG. 3 schematically depicts the ON and OFF times for a set of 4 LED units 100.1, 100.2, 100.3 and 100.4 through the curves 10.1, 10.2, 10.3 and 10.4 as a function of time t. For example, curve 10.1 could represent the ON time 40 and the OFF time 30-40 for a LED unit 100.1, while the curves 10.2, 10.3 and 10.4 represent the ON and OFF times for units 100.2, 100.3 and 100.4. Note that the duty cycle corresponding to curve 10.1 can be expressed as ON time 40 over time 30. During the ON time, a current can be provided to the LED unit; during the OFF time, the current can e.g. be redirected to a switch that is in parallel with the LED unit. See, as an example, switch 80.2 in FIG. 2 that is arranged to short-circuit the LED unit 70.2. During the ON time, said switch 80.2 can be open, during the OFF time, the switch 80.2 can be closed. FIG. 3 further schematically depicts a curve 20 representing the forward voltage 200 over the serial connection of the 4 LED units. Referring to FIG. 2, this forward voltage would substantially correspond to the voltage observed at the output 8 of the power supply 300 (neglecting the voltage over the resistance 90). In the situation as shown, only a single LED unit is switched on at the same time. As such, the forward voltage over the serial connection of the 4 LED units will be moderate, e.g. 3-4 V. Assuming that the duty cycles for the LED units as shown in FIG. 3 correspond to the application of the nominal current of the power supply, FIG. 4 schematically depicts the required duty cycles for the LED units at a reduced current. In order to obtain the same output characteristic of the LED assembly, the duty cycles of the LED units may need to increase, e.g. compare the ratio 40/30 in FIGS. 3 and 4. As a result, as can be seen from curve 20 representing the forward voltage 200 over the serial connection of the LED units, the forward voltage 200 over the LED units can be substantially larger.

In accordance with the present invention, it has been observed that it may be advantageous to operate a lighting system by applying a reduced current (compared to the nominal current of the power supply) in combination with increased duty cycles for driving the LED units of the LED assembly of the lighting system. Applying a reduced current, will in general, as illustrated in FIGS. 3 and 4 require adjusted duty cycles of the LED units that will be larger than the duty cycles required at nominal current. Operating a LED assembly at a reduced current and corresponding increased duty cycles for the LED units of the assembly may have one or more of the following advantages (reference numbers refer to elements as shown in FIG. 2):

The dissipation occurring in switcher element 2 of the power supply 300 may be reduced when a reduced current is applied. In order to provide the required (reduced) current to the LED assembly, the switcher element 2 of the power supply will operate at a certain duty cycle (further on referred to as $DC_{sw}$). In case the forward voltage over the serial connection of LED units is increased due to the application of the reduced current, this duty cycle $DC_{sw}$ may be larger compared to the application of the nominal current. The dissipation in the switcher element is proportional to this $DC_{sw}$, but is also proportional to the square of the current provided. Overall, this may result in a decrease in dissipation.

In case the switcher element 2 is open, the output current 7 of the power supply flows through the diode 4, resulting in a dissipation in the diode. In general, this dissipation is proportional to the current through the diode and proportional to the fraction of time the current runs through the diode, i.e. $(1-DC_{sw})$. Therefore, in case the application of a reduced current results in an increase of $DC_{sw}$, the dissipation in the diode 4 may be reduced because of the reduction of $(1-DC_{sw})$ and because of the reduction of the current through the diode.

Similar observations can be made with respect to the LED assembly; the dissipation in the LED units may be reduced because of the reduced current (the dissipation being proportional to the square of the current), despite an increase in duty cycle. Equally, the dissipation in e.g. the switches 80 as shown in FIG. 2 may decrease: the switches will be closed over a shorter fraction of time as the duty cycle of the LED units increases, additionally, the current through the switches will be the reduced current, i.e. smaller than the nominal current.

In an embodiment of the present invention, the reduced current substantially corresponds to the nominal current multiplied with the largest duty cycle. By doing so, an adjusted duty cycle of approx. 100% will be obtained for the LED unit having the largest duty cycle. As the duty cycle of the LED units cannot be more than 100%, the reduced current as obtained in this way corresponds to the smallest current that enables the provision of the desired characteristic of the LED assembly.

Figure 5:
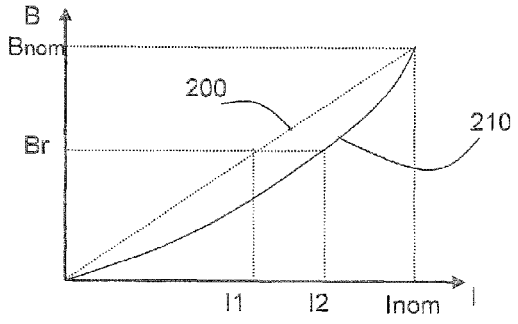
FIG. 5 schematically depicts a graph describing the brightness vs. current of a LED unit.

Note that the current reduction as described in the previous paragraph assumes a linear correspondence between the output of the LED unit and the current. In case this is not true, a correction can be applied to the reduced current to ensure that the desired characteristic of the LED assembly is met. This is illustrated in FIG. 5. FIG. 5 schematically depicts a brightness (B) characteristic for a LED unit. The brightness (B) characteristic shows the brightness (B) as a function of the current through the LED unit. Indicated on the graph is the brightness Bnom corresponding to the nominal current Inom. In case of a linear correspondence between the brightness and the current (graph 200), a reduced brightness Br would be obtained when a current I1 is applied in stead of Inom. In case the actual characteristic of brightness vs. current is in accordance to graph 210, a current I1 will produce a brightness smaller than Br. In order to obtain a brightness Br, a current I2 is required. In case the largest duty cycle of the LED units (as calculated based on the nominal current) would correspond to Br/Bnom, a current reduction of Inom to I1 would results in a reduced brightness that cannot be compensated entirely by increasing the duty cycle, as this would require a duty cycle above 100%. Rather, based on the brightness vs. current characteristic of the LED unit (which e.g. can be determined by experiments) the current can be reduced to I2. Apply a current I2 combined with an increase of the duty cycle (increasing the duty cycle Br/Bnom by a factor of Bnom/Br) results in the same brightness characteristic.

The control unit according to the present invention can advantageously be applied for controlling a LED assembly comprising two or more LED units that are connected in series. As explained above, the determination of the duty cycles for the multiple LED units using a control unit according to the present invention may result in an improvement of the efficiency of the power supply powering the LED units. In general, adjusting the duty cycles of the LED units as described above may result in the application of larger duty cycles in order to compensate for the application of a reduced current. It has been observed that the application of a larger duty cycle for a LED unit may have a further advantage in that it may reduce flicker. Flicker of a LED assembly may occur as either visible flicker or non-visible flicker, the latter may e.g. cause nausea. When a LED unit is e.g. operated at a duty cycle of 90%, a smaller occurring flicker can be observed compared to a duty cycle of e.g. 10%.

According to an other aspect, the present invention provides in an improved way of powering a LED assembly comprising a plurality of LED units, arranged in parallel, each LED unit being powered by a different power supply, e.g. a switched mode current supply such as a buck or boost converter.

To illustrate the improved way of powering, assume the LED assembly to comprise two LED's connected in parallel, each provided with a switched mode current supply for providing a current to the LED. The light emitted by the LED's having substantially the same color.

In such case, in order to realise a desired brightness from the LED's taken together, the conventional way is to adjust the duty cycles of the different LED's in the same manner.

As such, a desired brightness of 50% of the nominal (or maximal) brightness, can be realised by controlling both LED's substantially at a duty cycle of 50%. Note that a correction as discussed in FIG. 5 may equally be applied.

In accordance with an aspect of the present invention, an alternative way of operating the different LED's (or LED units) is proposed:

It has been observed that the efficiency of a switched mode power source may vary, depending on the load to be powered (i.e. the LED's or LED units) or the operating conditions (e.g. the current to be supplied, the duty cycle of the load). As explained above, losses in the switcher element or diode of the power supply may vary with these conditions.

Rather than controlling the different LED's in substantially the same way (i.e. have them operate at the same duty cycle), the present invention proposed to take the actual efficiency characteristic of the power supplies into account. In the example as discussed, a brightness of 50% may equally be realised by operating one of the LED's at 100% duty cycle and the other LED at 0% duty cycle. As the efficiency of the power supply when powering a LED at a 50% duty cycle may be lower than the efficiency at a 100% duty cycle, the application of different duty cycles may prove advantageous. Assuming the efficiency characteristic of the power supplies is known, a control unit can be arranged to determine which combination of duty cycles provide for the best efficiency for a given desired characteristic of the LED assembly. An efficiency characteristic of a power supply can e.g. be determined experimentally or based on theoretical considerations.

Figure 6:
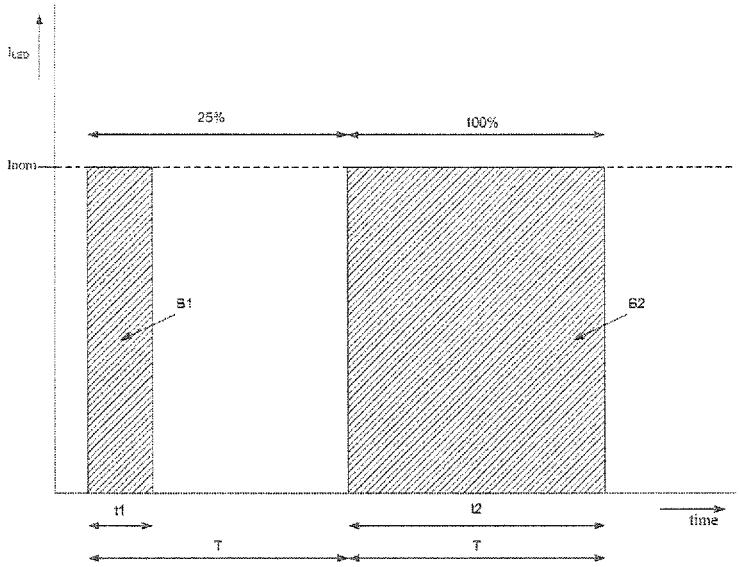
FIGS. 6 and 7 depict time diagrams of duty cycling according to the state of the art.

FIG. 6 depicts a time diagram to illustrate a duty cycling of LEDs according to the state of the art. Time is depicted along the horizontal axis while the LED current as provided by the power supply (e.g. the current provided by the power supply 300 in FIG. 1) is depicted along the vertical axis. In traditional duty cycling of a LED for brightness control, a constant, nominal current Inom is sent through the LED during ON time and is obstructed to flow through the LED at OFF time—in the configuration according to FIG. 1 e.g. by a closing of the parallel switch, as explained above. An average brightness is proportional to surface B1 and B2 respectively as indicated in FIG. 6. At the given nominal current Inom, the average brightness is proportional to the factor t/T. In the graph two examples are given, a first one depicted in the left half of FIG. 6, where t1/T=0.25 and a second one in the right half of FIG. 6, where t2/T=1. In the examples depicted here, the on time of the LED or LEDs is formed by a single pulse. Alternatively, the on time period may be formed by a plurality of shorter time periods, together providing the desired duty cycle.

Figure 7:
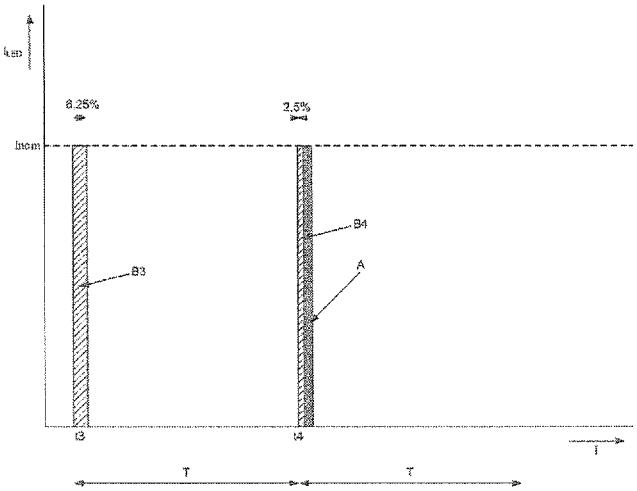

FIG. 7 depicts a time diagram of the LED current versus time, however at a lower duty cycle then in the examples provided by FIG. 6, to thereby illustrate a resolution limit in duty cycling according to the state of the art. Commonly, a duty cycle is modulated in a number of steps, e.g. expressed as a 16 bit number. A minimum duty cycle step is hence provided by the number of bits and the duty cycle time. At low duty cycles, changing the duty-cycle with the minimal duty cycle step, f.e. from t3 to t4, has a relatively high impact on the average brightness. In FIG. 7, bringing back the duty cycle from t3 to t4, reduces the brightness by a factor A/B3, hence providing, percentagewise, a substantial reduction which may be noticeable to the user as a sudden decrease in brightness.

In the concept of duty cycle dimming, a brightness resolution is therefore limited by the duty cycle resolution.

Figure 8:
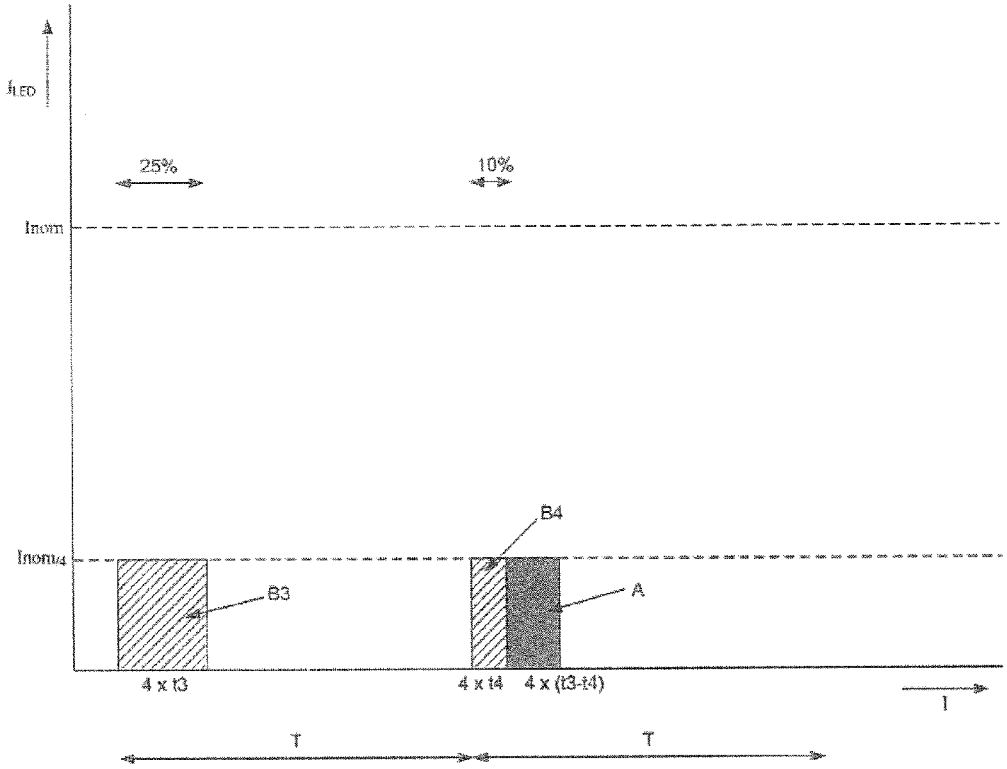
FIGS. 8, 9 and 10 depict time diagrams to illustrate further aspects of the invention.

FIG. 8 depicts a time diagram of the LED current versus time to illustrate how extra room for higher resolutions is achieved by lowering the LED current. The same brightnesses (depicted by B3 and B4 in previous FIG. 7) can also be achieved by lowering Inom and increasing the t/T (duty cycle) by a factor which substantially corresponds to the decrease in duty cycle. The larger duty cycle at the lower Inom will increase a brightness resolution as the duty cycle can then be altered in smaller steps. Thereby, the brightness may be controlled at a higher resolution with the same duty cycle t3-t4 steps as described above, as the larger duty cycle makes it possible to decrease the duty cycle at a higher resolution.

The above may be illustrated by a simple example: if at nominal power supply current t3 would be 0003 (Hex) and t4 0002 (Hex), then this minimum step of 0001 (Hex) would reduce the duty cycle by 33%, hence providing a brightness step of 33%. In case the current would be reduced by a factor 4, and hence the duty cycle would be increased by the same factor 4, then starting at a new value for t3: 4x0003 (Hex) providing 000C (Hex), would allow to increase or decrease the duty cycle in steps of 0001 (Hex), hence providing a brightness step of approximately 8%, thereby allowing a more smooth dimming.

Generally speaking, the concept of dimming the LEDs by a combination of duty cycle dimming and reducing the power supply current may, depending on the configuration, implementation, dimensioning, and other factors, provide for one of more of the below effects:

Smooth dimming may render a comparably lower amount of noise and flickering:

Noise:

A lower amount of noise may be produced by this method when compared to using only time duty cycling. Noise may be caused by electronic components, such as capacitors and coils, vibrating internally under varying voltage across or current through them. The lower noise may be due to the lower current through the LEDs flowing a higher percentage of the time, which may cause different frequency components that make up the current. The amplitude of frequency components causing noise may be lower. Also, the current value may be lower at lower brightnesses, which may cause lower mechanical forces in components like coils.

EMI:

Because of the lower content of higher frequency components, EMI may be lower.

Flickering:

As explained elsewhere in this document, as part of the dimming is done using more or less current, the visible flickering effect may be less then when achieving the same with an abrupt switching off and switching on of the current.

Further, because of the extra degree of freedom, a better optimum may be found while trading off time pulse width against current change pulse width against current absolute value.

Unnoticeable color shifts:

Because of the smoother brightness setting per color, also the total color may be set more accurately and a color change may be made smoother.

Figure 9:
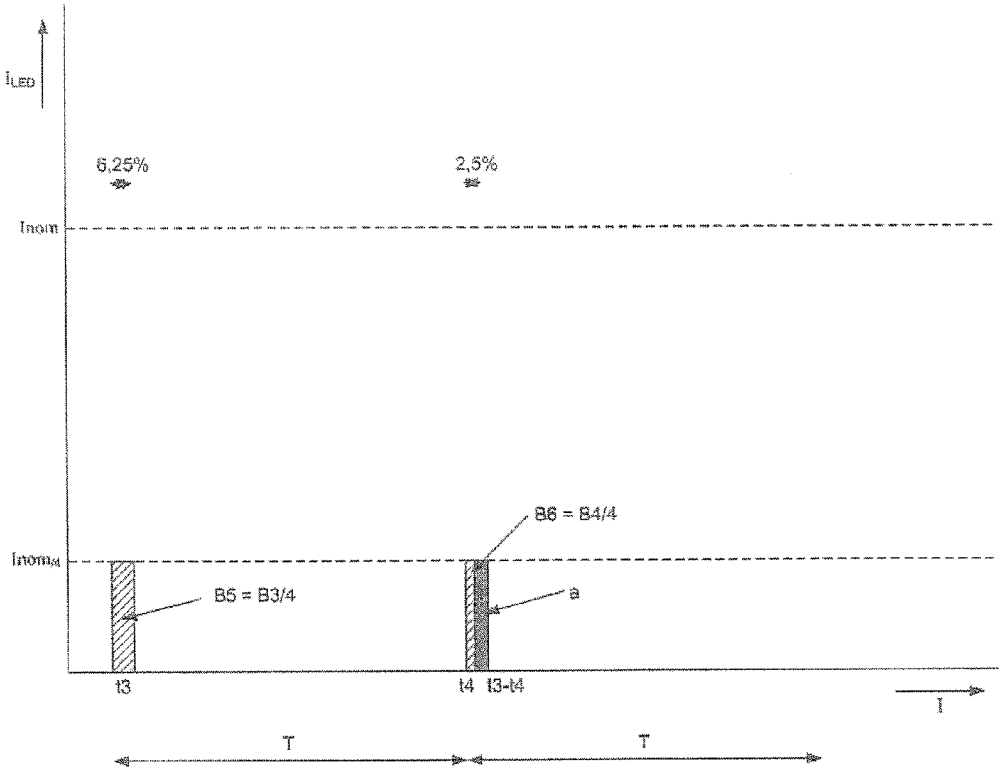

FIG. 9 depicts a time diagram of the LED current versus time to again illustrate how the higher resolution in brightness may be achieved by using a smallest duty cycle step in time. By making the smallest step in resolution at the lower Inom, the 'A' surface in the previous figure diminishes to the 'a' surface in the figure below, thereby controlling the brightness at a much higher resolution.

Figure 10:
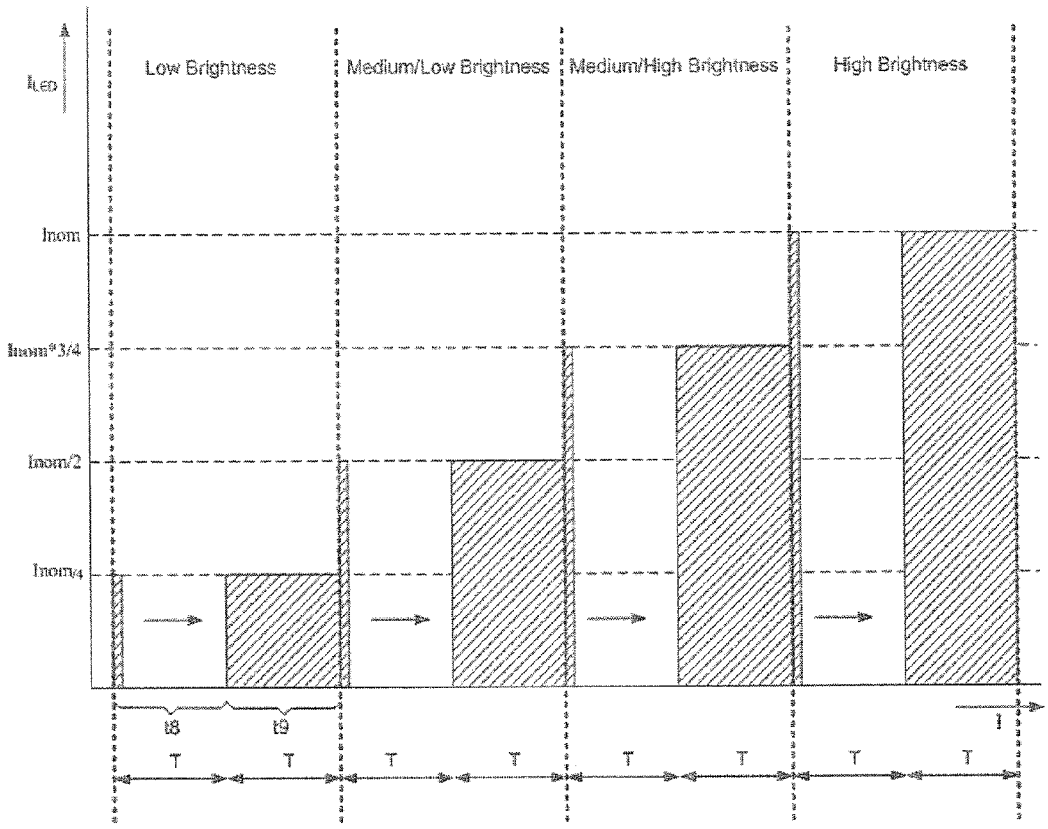

FIG. 10 depicts a time diagram of the LED current versus time to illustrate how the time duty cycle can be applied from 0% to 100% at various values for Inom, thus delivering various brightness steps per duty cycle step. Combined with the logarithmic sensitivity of the human eye, this provides small brightness steps at low brightness. As will be explained in more detail below, by switching Inom using e.g. a 6 to 8 bit potentiometer from a low value at low brightness setpoints to a high value at high brightness setpoints and controlling the brightness in between those points using duty cycling from 0 to 100%, the brightness can be controlled at a very high resolution of f.e. 20 bit by a combination of e.g. a 16 bit duty cycle and a 4 bit potentiometer. FIG. 10 depicts an example thereof for a 2 bit potentiometer, hence for 4 values of the nominal LED current. In a leftmost part of the figure, indicated by t8, t9, the power supply current has been reduced to Inom/4, allowing a brightness range from a smallest duty cycle (symbolically depicted by t8) to a largest duty cycle (depicted by t9). Increasing, in the next part of FIG. 10, the duty cycle to Inom/2 again allows a similar duty cycle range, which is again possible for Inom*¾ and Inom, as depicted in the third and forth part of FIG. 10. Thereby, for each of the currents, a duty cycle range, and hence a brightness range is provided. In the chosen combination of a 16 bit duty cycle modulation and a 2 bit current modulation, the ranges will overlap, resulting in a total dimming range of 18 bit.

Figure 11:
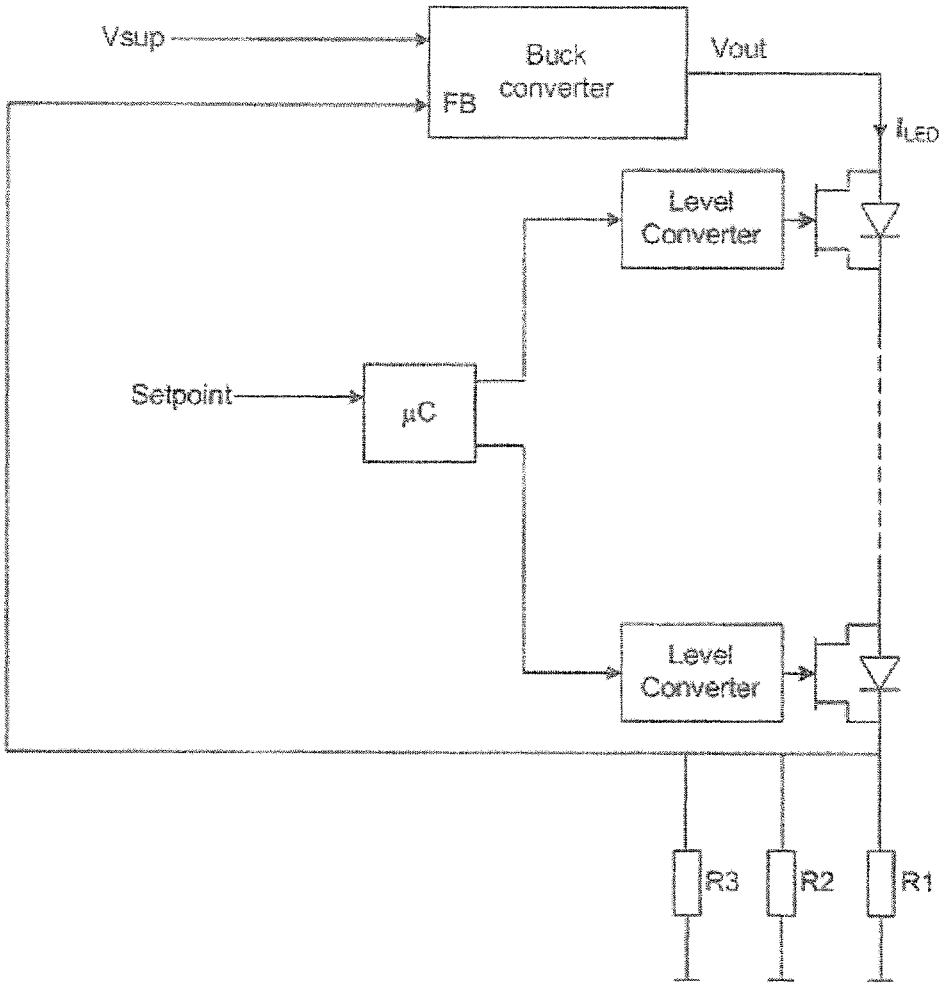
FIGS. 11-14 depicts a circuit diagrams to illustrate aspects of the invention.

FIG. 11 depicts a highly conceptual circuit diagram to illustrate a traditional current control. The current $I_{LED}$ delivered by the current source provided by in this example a buck converter topology from a supply voltage Vsup, is fed through the LEDs and through the parallel resistances R1, R2 and R3.

A voltage drop across the R1 through R3 resistance is fed back to the current source at a feedback input FB of the buck converter, thereby enabling control of an amplitude of the current. Duty cycle is controlled by the microcontroller μC, which, in response to a setpoint at a corresponding setpoint input, controls switches, such as in this example switching transistors, connected in parallel to each of the LEDs or LED groups. In order to take account of possible potential differences, the switches are controlled by the microcontroller via respective level converters.

As explained above, the current source in this example controls its output current by controlling the voltage present at input FB to a fixed value. By changing the total R1 through R3 resistance, f.e. by mounting different values for R2 and/or R3 or even leaving them out altogether, different current values can be set that will deliver the same voltage at pin FB.

In this manner the nominal current Inom can be set to different values, e.g. for different applications.

Figure 12:
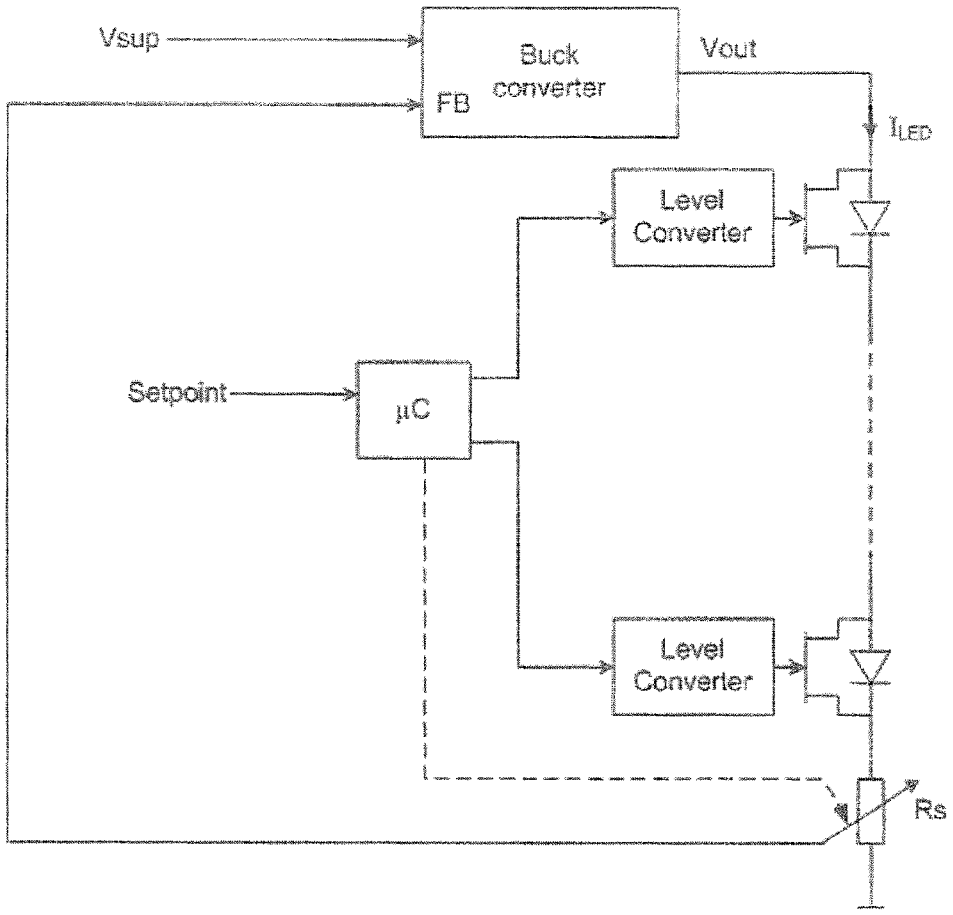

FIG. 12 depicts a highly schematic circuit diagram to illustrate a principle of replacing the above feedback resistance (typically only changeable through soldering) from the previous figure by a potentiometer. In this example, the potentiometer is connected such as to feed back a part of the voltage across the series resistor Rs to the pin FB. Thereby, the feedback voltage at the FB input is controlled, which provides for a controlling of the value of the LED current $I_{LED}$.

The digital potentiometer may be controllable by the microcontroller uC (as indicated by the dotted line) and thus by a suitable software programming and may form an integral part of the brightness and color control algorithm in the microcontroller uC. Especially the very flexible set of algorithms as described in WO2006107199 A2. Making use such algorithms, very smooth take-over profiles can be achieved when changing the $I_{nom}$ (and consequently time duty cycle settings).

Note that the Rs resistance typically is very small and that potentiometers in general have larger values. A more practical arrangement will be described below.

Figure 13:
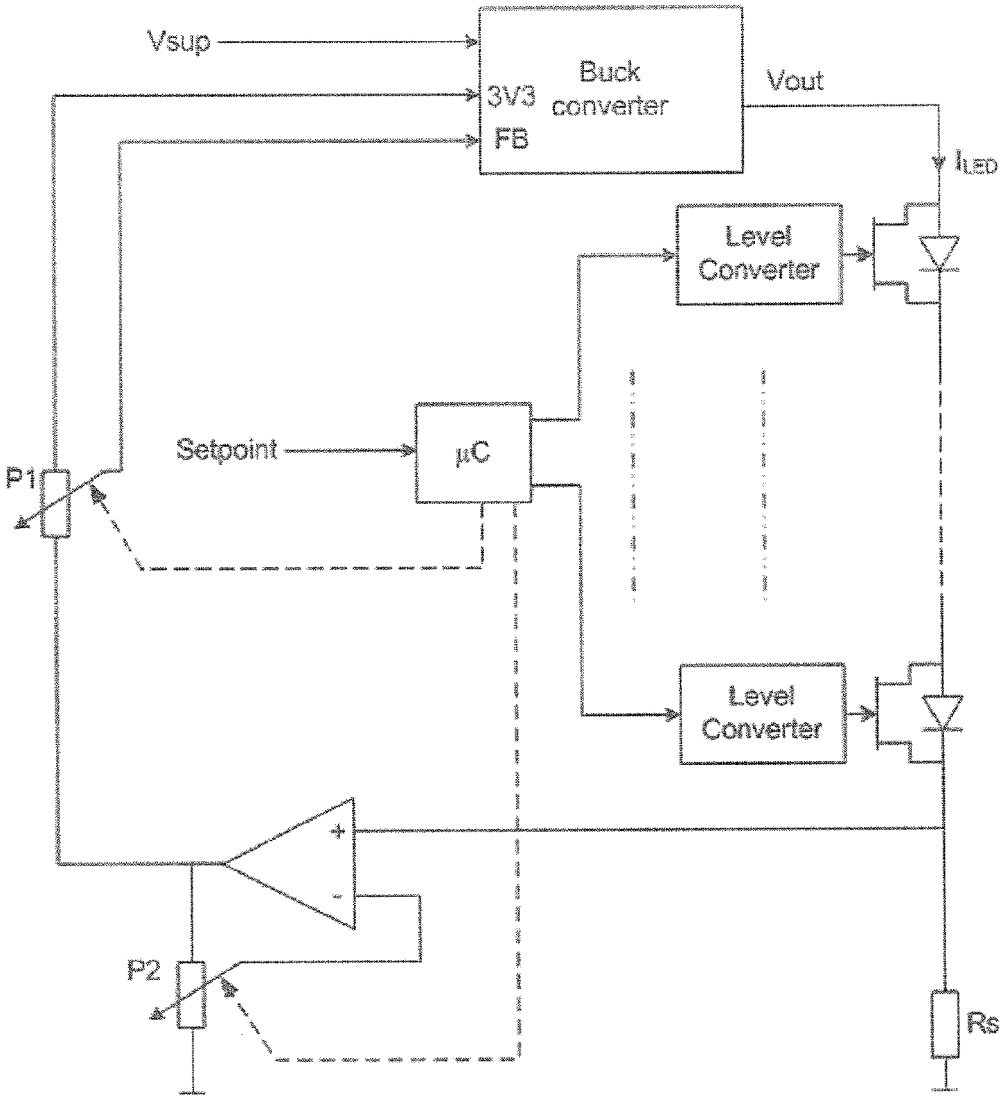

A more practical arrangement (though still a principle schematic) is provided in the highly schematic circuit diagram in FIG. 13

In the circuit depicted here, the voltage across the (possibly very low ohmic) series resistor Rs is amplified by an amplifier circuit comprising in this example an operational amplifier and potentiometer P2 as a voltage feedback network, and level-shifted by potentiometer D1 connected between an output of the amplifier circuit, a reference voltage (indicated in FIG. 13 as 3V3), Consequently, amplification and level-shifting can be set using potentiometers P1 and P2. Several opamp topologies can be used, as will be appreciated by those skilled in the art, to optimise this circuit, for example to achieve an independent level and amplitude control, or to optimise the value of Rs. Even the behaviour of the current control loop at higher frequencies can be influenced by choosing appropriate feedback circuiting. Instead of the potentiometer P1 use could also be made of a digital to analogue converter, e.g. a multibit converter or a digital duty cycled signal filtered by a low pass filter, in order to provide a microcontroller controlled voltage or current to the feedback circuit.

Figure 14:
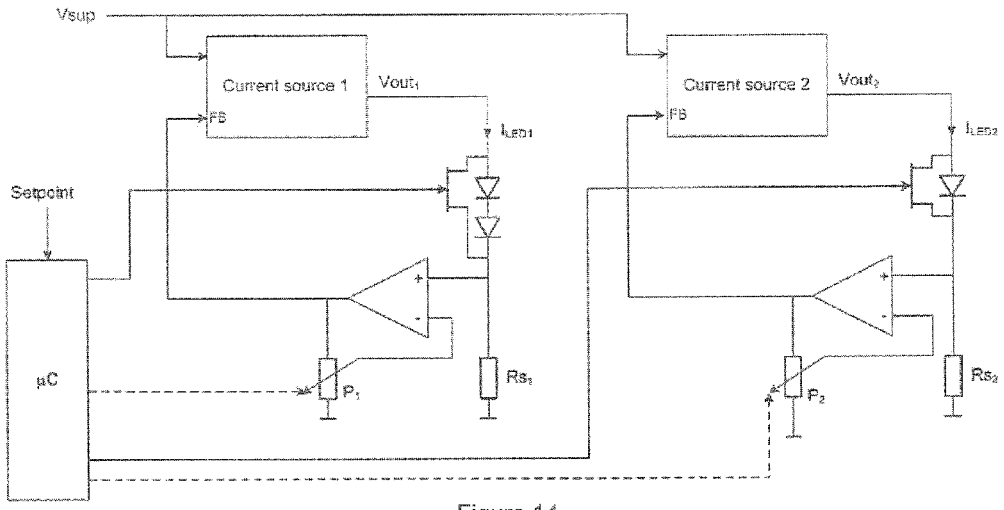

The above principles can be used for multiple LED chains, either by using complete double circuitry, by sharing the microcontroller uC, by sharing the microcontroller uC and the current source etc. An example is illustrated in the highly schematic circuit diagram of FIG. 14. In this figure, a current source is provided per group of LEDs (e.g. per LED unit), each group e.g. providing a different color, so that for each color the current and corresponding duty cycle can be set independently. Hence, a dimming of one of the colors, and a corresponding change in current, will not affect a duty cycle of the other colors, as the current for these colors is independently set. In FIG. 14, each control loop comprises a respective operational amplifier circuit to amplify the voltage across the respective series feedback resistor through which the respective power supply current flows. The respective output of the opamp circuit is connected to the respective feedback input FB of the respective converter. A voltage amplification factor of the opamp circuits is set by the respective potentiometer setting, in order to set each of the power supply currents. Thereby, the brightnesses of each of the colors can be controlled more independently then in the above configurations, as a change in the current has an effect only on the respective color, and thereby avoids the change in brightness that would instantaneously occur in the other colors, and that would have to be taken account of by altering the duty cycles of the other color(s). Especially in the situation where different colors are operated simultaneously with the same power supply current, an undesired temporary change of other colors (as observed by the human or technical observer) could occur, as it takes some time for the microcontroller to arrive at time windows in which the duty cycles of the other colors are to be amended in order to take account of the change in current.

In other words, a plurality of parallel branches may be provided, each comprising at least one LED unit, a respective switched mode power supply being provided for each of the branches, the control unit being arranged for determining a power supply current for each of the power supplies, depending on the desired output characteristic for the respective LED unit, and for providing output data for each of the power supplies.

Figure 15:
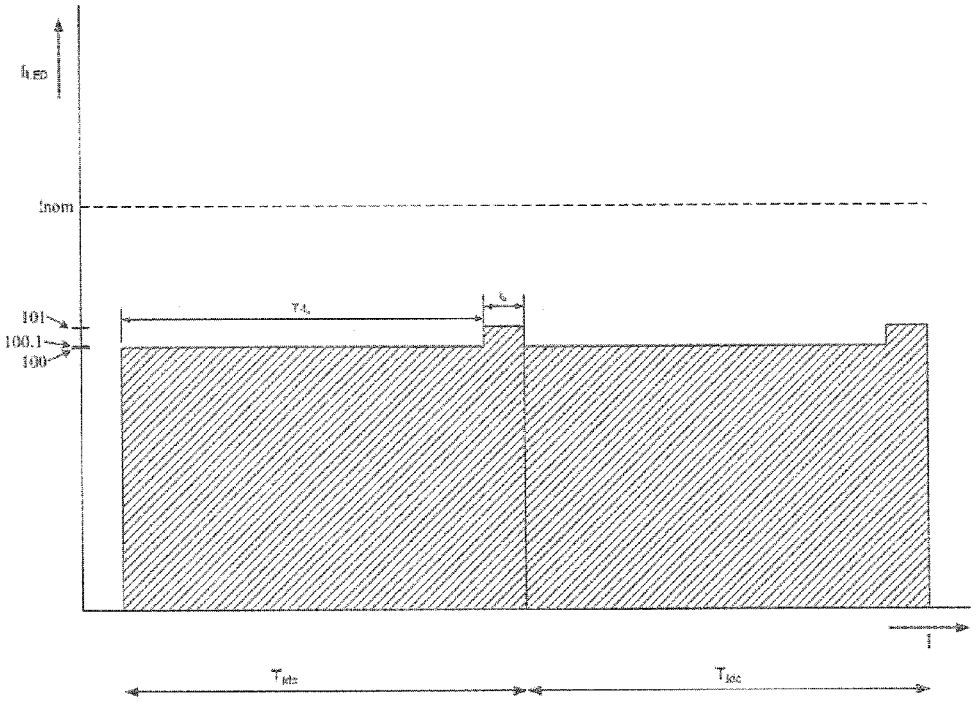
FIGS. 15, 16 and 17 depict time diagrams to illustrate still further aspects of the invention.

FIG. 15, depicts a time diagram of the LED current versus time to illustrate how even higher resolution may be provided. Thereto, "current duty cycling" is introduced. Thereto, in this example, a potentiometer with a higher resolution is used, for example an 8 bit potentiometer which provides 256 steps in the current, hence providing for example a current resolution of 1.4 mA at Inom=350 mA (350/256=1.4). In FIG. 15, the minimum step has been chosen to be 1 mA on a base setting for the current of 100 mA. By having a current of 101 mA during ta and of 100 mA during T-ta, the average current is 100.1 when ta is 10% of T. Choosing the ta/T factor or "current duty-cycle" (as opposed to the time duty-cycle disclosed in WO2006107199 A2 or a PWM-like algorithm), the average current can be fine tuned thus providing extra resolution. Thereby, resolution can thus be increased further, adding the resolutions of the time duty cycle of the parallel switches, the current level resolution and the current duty cycle resolution. Besides or instead of the increase in resolution, other effects may occur, such as a reduction of flickering, noise and/or electromagnetic interference. The additional degree of freedom provided thereby may be applied to optimize efficiency, color display, software complexity (hence required processing power of the microcontroller) or any other suitable parameter such as noise, electromagnetic interference, flickering, etc.

Figure 16:
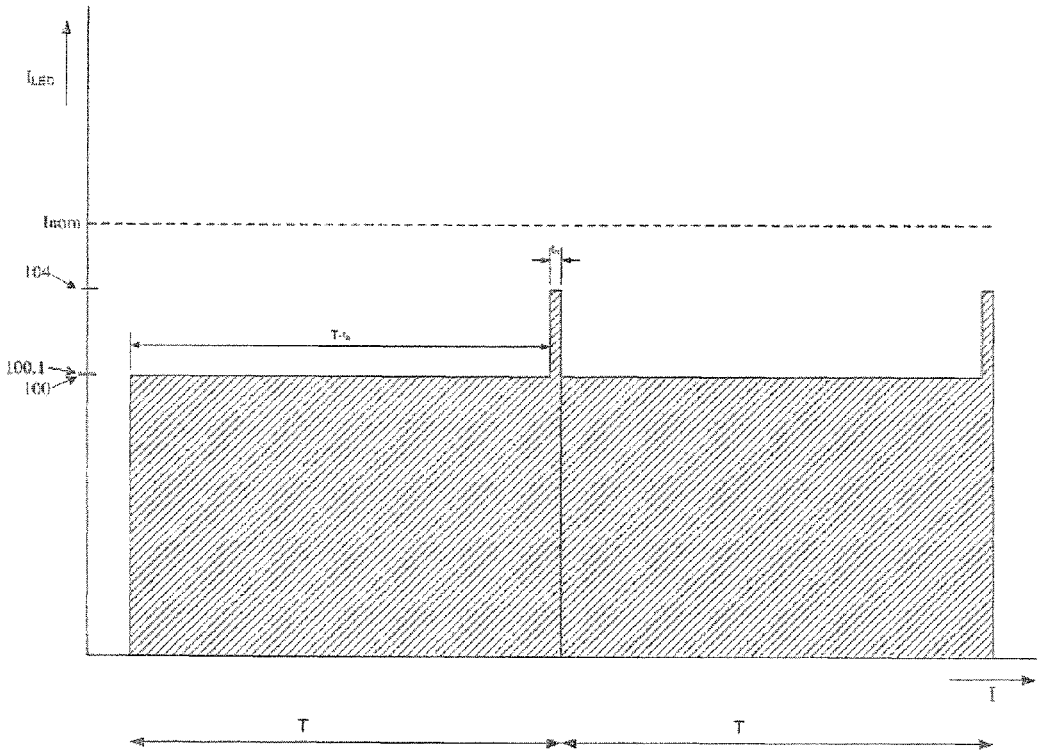

In FIG. 16, which depicts a time diagram of the LED current versus time to illustrate how such mechanism enables achieving high brightness resolutions even when Inom cannot be below a certain threshold dictated by current stability and or color shift. (In a certain range, the color shifting could even be used for fine-tuning the color setting.)

In this figure, it is shown that, given a certain average LED parameter (f.e. Brightness), different settings can be chosen to achieve that average brightness. For example, one could choose the values used in FIG. 15 (100, 101, 10%) or the values used in this figure (100, 104, 2.5%) to achieve 100.1 mA average current. A current profile such as depicted in FIG. 16 may also be applied to synchronize with an image capturing rate of a camera.

This freedom in alternative settings can be used to trade-off between avoiding visible frequencies, smoothness of the control, circuit cost and limitations, software complexity, electromagnetic interference, noise, etcetera. (For example, the higher frequency content in a 2.5% pulse is generally higher than in a 10% pulse given the same period T.)

Figure 17:
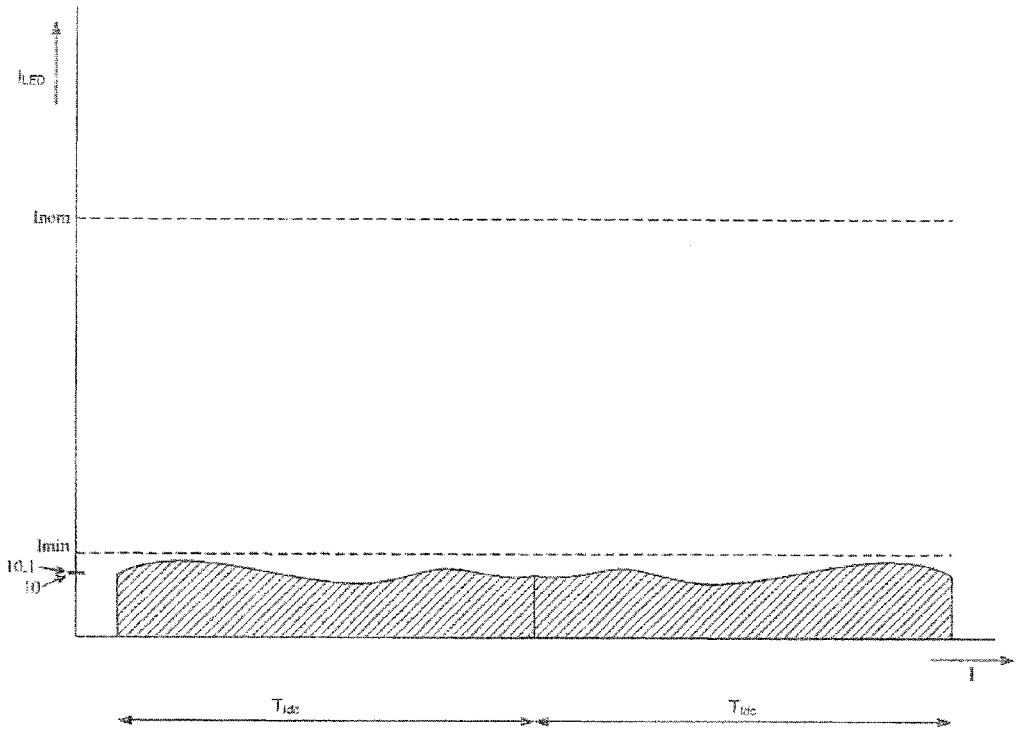
Figure 18:
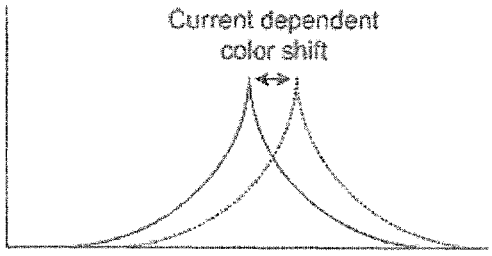
FIG. 18 depicts a spectral diagram of a LED spectrum.

FIG. 17 depicts a time diagram of the LED current versus time to illustrate effects introduced by a too low power supply current. As a first effect, a ripple on the power supply current may occur due to instability of the DC/DC converter. Secondly, LEDs exhibit a behaviour wherein at a too low current, a "knee" in the brightness curve may occur resulting in LED color spectrum shift, unpredictable behaviour or other effects. Such a color spectrum shift is illustrated in FIG. 18, schematically depicting a spectral diagram of the LED output spectrum, and showing a first and a shifted second the color spectrum for a different LED current.

Figure 19:
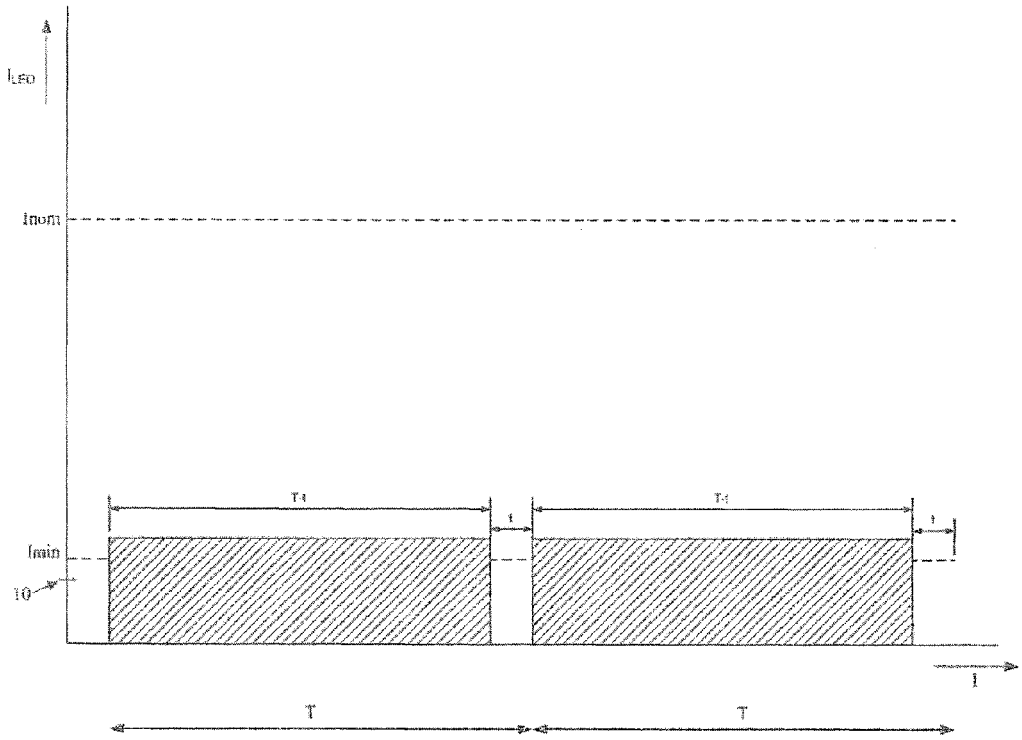
FIGS. 19 and 20 depict time diagrams to illustrate again further aspects of the invention.

FIG. 19 depicts a time diagram of LED current versus time. This figure illustrates how an average current below the minimum current can be achieved by operating the current source at a current above the minimum current for a first part T4 of the cycle time T, and switching off the current for a second part t of the cycle time T.

Thereby, possibly at the "cost" of some ultimate brightness resolution, an effective, low current may be achieved without the above mentioned color shift or instability problems as the momentary current in the duty cycle part T4 is kept above the minimum value.

The switching off may be obtained by appropriate setting the Potentiometer ratio (in a suitable feedback circuit configuration) or by closing the parallel switches during a certain part of the duty cycle time.

It is remarked that, because of the likely higher step in the current value, the importance of trading off between visible flickering and the choices for T and t increases. Given the many variables available now: duty cycle dimming, current dimming, current duty cycling, etc, many variables are available to be able to obtain a good tradeoff.

Figure 20:
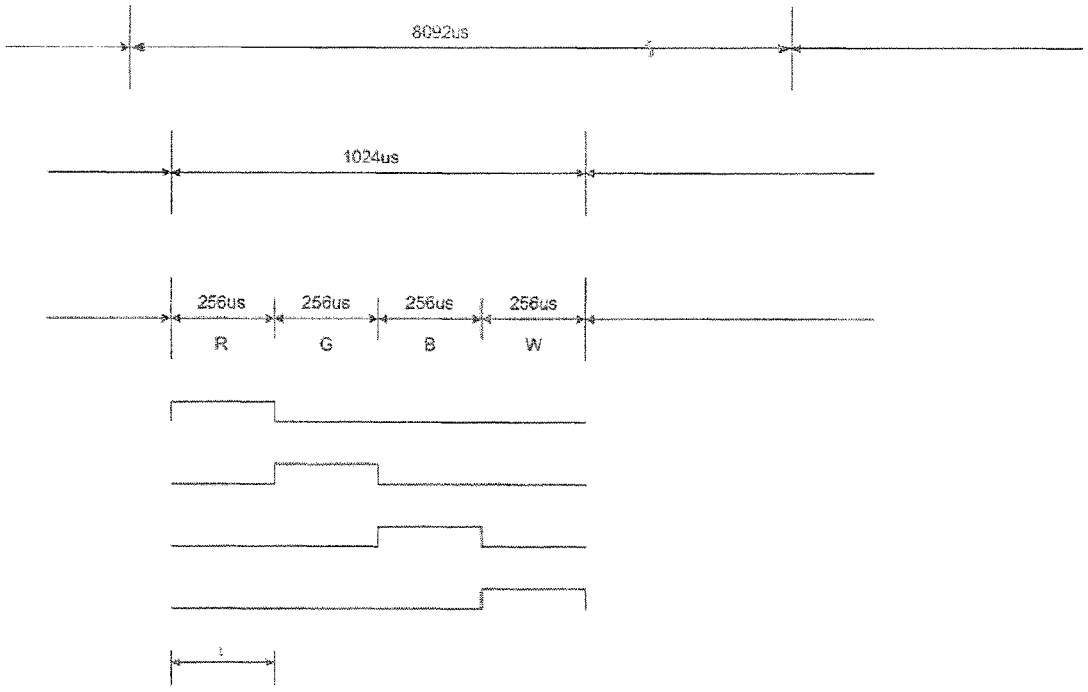

FIG. 20 depicts a time diagram of LED current versus time. In this embodiment, the current is set sufficiently large such that the time duty cycle for each color R, G, B and W does not need to be larger than 25%. Hence, the current algorithm as described previously in WO2006107199 A2 and where each color is primarily controlled in its own time quadrant (i.e. each part) of the cycle time, is greatly simplified, as it is only required to control each color in the quadrant meant for controlling that specific color thereby avoiding cross effects as in each quadrant only the appropriate color and no other color is required to be operational.

In this configuration, it is even possible to change the current during each part of the cycle time to a value that matches the desired output characteristic of the respective LED unit that is to be operated in that part of the cycle time. Thus, in case R, G and B are to be operated at a low brightness level while W is to be operated at a high brightness level, the current can be set to a low value in the cycle time parts corresponding to R, G and B, thereby allowing to drive the respective LEDs at a relatively high time duty cycle within that cycle part, while in the cycle time part corresponding to W, a higher power supply current is set.

In this way, it is also possible to avoid the low frequency components (f.e. having 8096 us as base frequency in a cycling scheme of 8 time periods of 1024 microseconds each) that would arise when trying to achieve high brightness resolutions using the above referred, known algorithm at maximum $I_{nom}$. Using e.g. such known algorithm to achieve high resolution would imply for example to set the duty cycle in 7 of the 1024 us periods for Red to 128 us/128 us while setting it to 125.5/130.5 in the eight one of the 1024 us periods. This would provide a slightly lower brightness, thus achieving a high brightness resolution, however it would introduce a brightness ripple, namely a 125 Hz frequency component, as only in one of the 8 time periods of 1024 us the brightness of the LED is different.

By lowering the Inom (either by lowering the current, or by duty cycling the current in each of the time periods) and thereby keeping the LED current behaviour the same in each of the 1024 us time periods, the above described low frequency effects may be avoided.

It is remarked that, at very high brightnesses, the eyes' sensitivity becomes less and lower frequency components needed to achieve 100% brightness may have less impact.

Hence, the various embodiments as depicted and described with reference to FIGS. 6-20 allow to increase a resolution at lower brightness by altering the current of the power supply, which may be achieved accurately and cost effectively making use of e.g. a digital potentiometer, i.e. a low cost, microprocessor controllable electronic component.

Figure 21A:
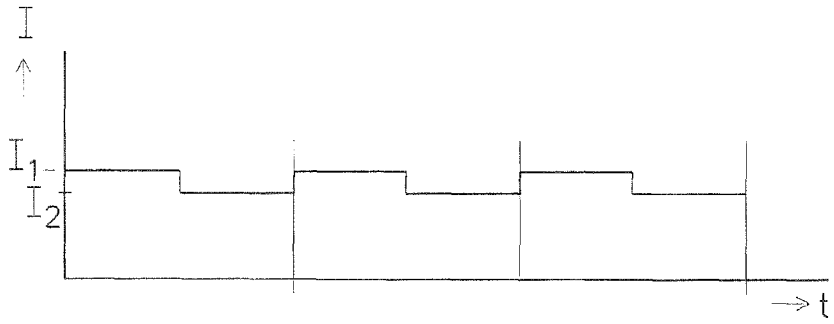
FIG. 21A-D depict time diagrams based on which an embodiment of the invention will be described.
Figure 21B:
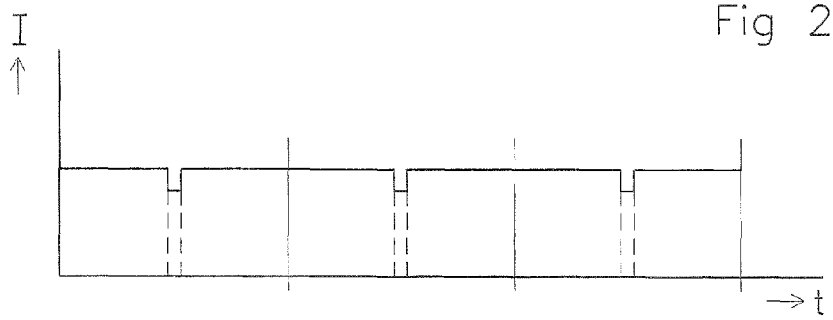
Figure 23:
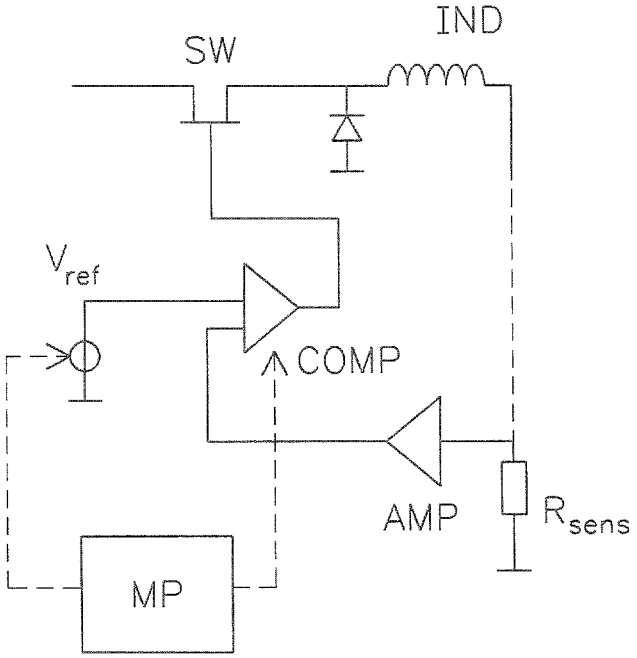
FIG. 23 depicts a schematic diagram of a circuit in accordance with an embodiment of the invention.

FIG. 21A depicts a graphical view of the LED current I versus time. An example of a circuit to generate this current is depicted in FIG. 23. The circuit comprises a switch SW, such as a field effect transistor or other semiconductor switching element in series connection with an inductor IND. The current flowing through the inductor then flows through the LED's, e.g. in series connection. Furthermore, in series with the LED's and inductor, a resistor Rsens is provided in order to sense a value of the current. The current value results in a voltage drop over the resistor Rsens, which is amplified by amplifier AMP and provided to an input of comparator COMP. A fly-back diode is provided for allowing current flow when the switch is non conductive. Different electrical configurations are possible, depending on the configuration, the current flows through the resistor Rsens in both the conductive and non conductive state of the switch, or only in the conductive state. Another input of the comparator is provided with a reference signal, in this embodiment a reference voltage provided by reference source Vref (also briefly referred to as reference). An output signal of the comparator, which represents a result of the comparison, is provided to a controlling input of the switch, in this example to the gate of the field effect transistor. A regenerative circuit is provided now, whereby a value of the current through the inductor, LEDs and measurement element averages a value at which the input of the comparator to which the amplifier is connected, equates the value of the reference voltage, thereby the comparator and switch periodically switching, resulting in a ripple on the current as well as on the voltage sensed by the resistor Rsens. At least one of the comparator COMP and reference source Vref is controllable by a microcontroller MP. In a practical embodiment, the comparator and reference source may be integrated, together with the microprocessor, into a single chip. Hysteresis may be added to the comparator. Therefore, the circuit topology described here sometimes being referred to as a "hysteretical converter" (with hysteresis or without).

Figure 21C:
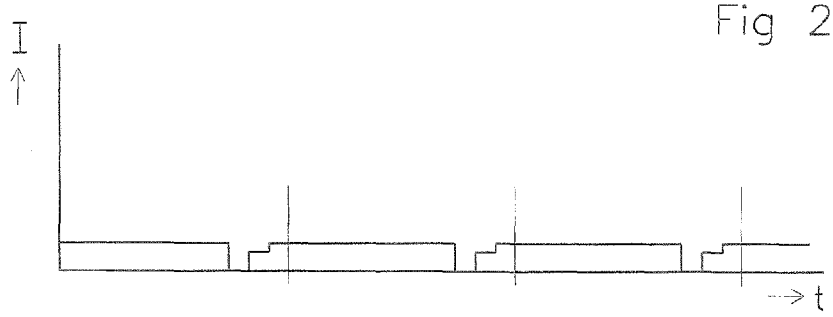
Figure 21D:
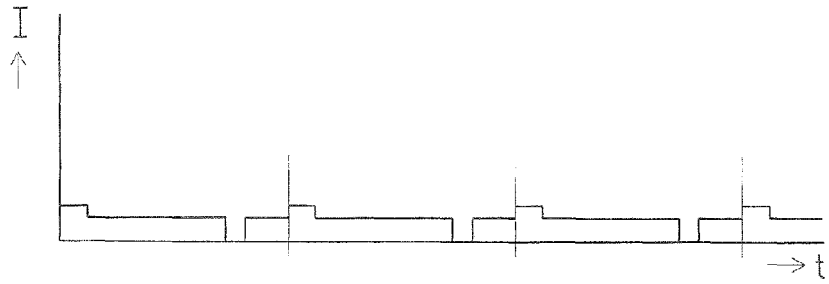

Reverting to FIG. 21A, the microprocessor (also referred to as microcontroller or controller) may control the reference source so as to provide different reference voltage values. This may for example be implemented by a microprocessor switchable resistive voltage divider network or any other suitable means. In case of an attenuation in 16 steps (by a 4 bit control) of the reference voltage, 16 different current values may be obtained, hence allowing a dimming of the LED current in 16 steps. In case a higher resolution would be required, the reference voltage may be set at a first value during a first part of a cycle time, and at a second value during a second (e.g. remaining) part of the cycle time. Thereby, an effective, average value of the current may be achieved in between the 16 steps, hence enabling a higher resolution dimming. A reduction of the current to a lower value during relatively shorter parts of the cycle time may allow precise adjustment of the required average current level. By controlling the reference source accordingly, the value during the short time period may be set to a desired lower or higher level, or for example to zero, so as to stop the LED current in this part of the cycle. At low current values, instability or other adverse or undesired effects may occur in the circuit as depicted in FIG. 23. Therefore, instead of setting the reference to a continuously low value (for example a value of 1 or 2 in a 4 bit coding), the value may be set somewhat higher, i.e. at a value where stable operation is ensured, whereby the current is reduced to substantially zero in a part of the cycle time, as depicted in FIG. 21C. In order to provide a smooth and defined start-up from the zero current condition, the current may, from the zero current condition, be increased stepwise, e.g. by a stepwise increase of the reference voltage value. FIG. 21D depicts the situation where during a part of the cycle the current is increased for increased resolution of the average current: e.g. in a cycle having 64 sub cycle time parts, whereby the current is set from value 3 to zero during 3 parts of the 64, an increase of the average current may be obtained at a relatively high resolution by setting the current value from 3 to for example 4 during one part of the 64, as schematically depicted in FIG. 21D. In each of the examples shown here, the current may be set by the microcontroller by controlling a value of the reference Vref. The condition of zero current may also be achieved by disabling the comparator (e.g. by an internal disabling of a microprocessor controlled comparator or by a switch or digital logic (not depicted in FIG. 23) that disables of blocks the output of the comparator.

Figure 22A:
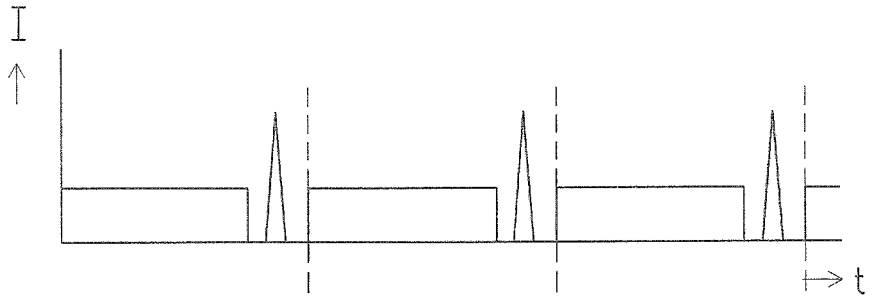
FIGS. 22A and B depict time diagrams based on which an embodiment of the invention will be described.
Figure 22B:
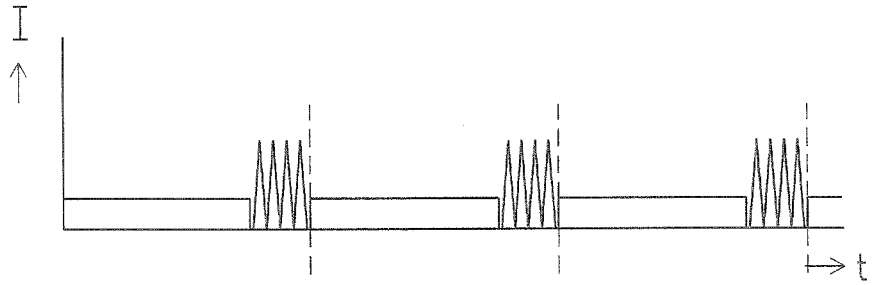

Further variants are depicted with reference to FIGS. 22A and B. Here, a current pulse is formed during a part of the cycle time. The current pulses may be generated in many ways: it is for example possible to switch the reference Vref from zero to a certain nonzero value, which then results in an increase in the current, while after a certain time (e.g. a lapse of time determined by the microprocessor, a first switching of the comparator and switch SW to the non conductive state of the switch, etc.) the operation is stopped by for example disabling the comparator or setting the value of the reference back to zero, causing the current drop to zero again. Calibration may be performed to determine an effective current value or brightness or brightness contribution of such pulse. One pulse may be provided per cycle (FIG. 22A) or a plurality thereof (FIG. 22B). Although in FIG. 22B the pulses are depicted so as to directly follow each other, it will be understood that the pulses may also be provided with a time in between, thereby achieving a further dimming. In an embodiment, dimming may be provided by increasing a time distance between successive pulses.

By a corresponding setting of the value of the reference Vref, an amplitude of the pulse may be set. As the pulses may provide for a comparatively lower effective current then a continuous current, a resolution may be further increased by combinations of parts of the cycle during which a continuous current is provided, and parts of the cycle during which the current is pulsed. Thereby, by a corresponding setting of the reference, different values of the continuous and/or the pulsed current may be obtained within a cycle. Calibration of the pulses may be performed in various ways, e.g. timing a pulse width by a timer, filtering a sequence of pulses by a low pass filter, measuring a pulse shape using sub-sampling techniques. Also, feedback mechanisms such as optical feedback (brightness measurement) may be applied.

It will be understood that, although the above explains the controlling of the reference (so as to set the current) and the pulsing in a free running configuration as depicted in FIG. 23 (also referred to as a hysteretical configuration), It will be understood that the above principles may be applied in any other (e.g. switched mode converter) configuration too.

In another embodiment, asynchronous sampling is used by the microprocessor in order to determine a time of switching off the comparator. Thereto, the microprocessor samples an analogue signal representing the current through the inductor and LED's, e.g. by sampling the signal at the output of the amplifier AMP for amplifying the signal measured by Rsens. Due to the free running character of the hysteretical or other converter, an asynchronous sampling is provided enabling to determine the waveform and hence the switching on and/or off of the comparator with a comparably high resolution. For this purpose, the current may be sampled and/or the output of the comparator. In order to provide a low average current through the LED's, the microprocessor may now disable the hysteretical converter (or other type of converter) by either setting after a time (e.g. prior to the finalisation of the cycle of oscillation of the converter itself) the value of the reference source back to zero, by overriding or by disabling the comparator or by any other suitable means to force the switch SW to the desired state. As a result, comparably short current pulses are created, shorter than could have been provided by letting the oscillator run on its own motion, the current pulses having such short time duration enable a low level and/or high resolution dimming. A frequency of repetition of the pulses may be determined by the microprocessor by the time until a following enabling of the converter (by e.g. a following setting of the reference generator and/or a following enabling of the comparator. Thereby, current pulses may be generated e.g. 1, 2, 3 of N (N being an integer) times per cycle time. Furthermore, it is possible to synchronise the switching of the converter to cycle times of the operation of the microprocessor by the described interaction by the microprocessor on the comparator.

The above principle may be applied in a method for dimming of the LED current provided by a driver. The method comprises:

dimming an effective current by disabling the converter (e.g. a hysteretical converter) during a part of cycle time; this may be performed until a level of for example ¼ or ⅛ of the maximum (i.e. 100%) current level. Then, further dimming is provided by dividing a cycle time of the operation in cycle time parts, an example of a cycle frequency could be 300 Hz, as it is a multiple of 50 Hz and 60 Hz mains frequencies and a multiple of common video image capturing frequencies. The cycle time could then for example be divided in 128 parts so as to provide sufficient resolution. Dimming may be performed by during each cycle time part, enabling the converter at a beginning of the cycle time part and disabling the converter during the end of the cycle time part. Prior to the disabling, the value of the reference is increased, so as to force the comparator to switch on the switch, thereby providing for a defined switching off behaviour, a reduction of jitter by the effects of the asynchronous operation of the converter with respect to the cycle time and cycle time parts, and hence a more defined dimming behaviour. A gradual transition towards the situation where the current is increased at the end of each cycle may be obtained by gradually activating this higher current during 1, then 2, then 3, etc cycle time parts of each cycle. With progressed dimming, the part of the cycle time part during which the converter is enabled is made that short that only the part remains where the reference is increased. Further dimming may then be provided by decreasing (e.g. per cycle time part) the value of the reference, and still further dimming may be obtained by keeping the converter shut down during some of the cycle time parts.

Figure 24A:
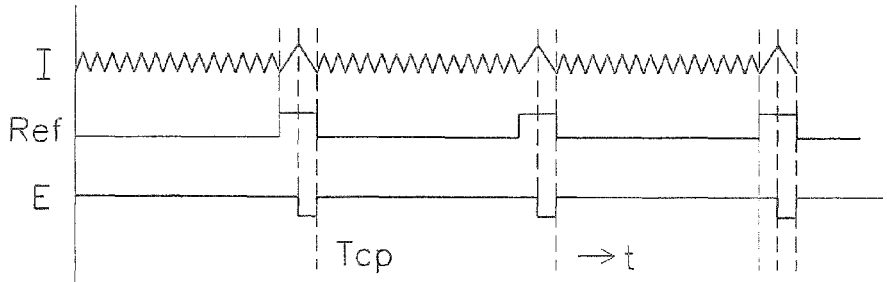
FIG. 24A-C depict time diagrams based on which an embodiment of the invention will be described.
Figure 24B:
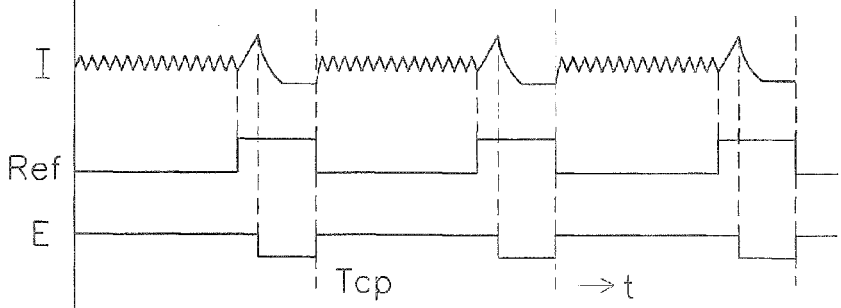
Figure 24C:
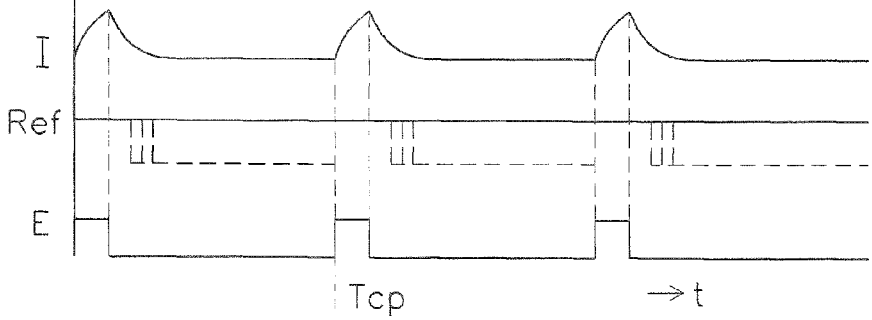

The above process is illustrated in FIGS. 24A-24C. Each of FIGS. 24A-24C depicts the current I of the converter, the reference value Ref and an enable signal E that enables/disables the converter (e.g. by enabling/disabling the comparator), during 3 cycle time parts Tcp. In FIG. 24A, free running operation of the converter is enabled until almost the end of the cycle time part Tcp. Then, the reference is increased which causes an increase of the current to a higher level, followed by a disabling of the converter by a corresponding level of the enable signal E. In FIG. 24B, the same processes are started earlier in the cycle, causing the current of the converter to drop to zero during the final part of each cycle time part Tcp. In FIG. 24C, the dimming has progressed further, causing only the increase of the current. Followed by a decay to zero to remain. Thereto, the reference is set to a high value during at least the part of the cycle time part during which the current increases. Further dimming is possible, as explained above, by a reduction of the pulse height and/or time duration (by reducing the value of the reference and/or a reduction of the enable time during which the converter is enabled) of one or more of the pulses of each cycle. The dimming may be implemented in the driver by e.g. a corresponding programming of the microprocessor or other microcontroller thereof.

Figure 25A:
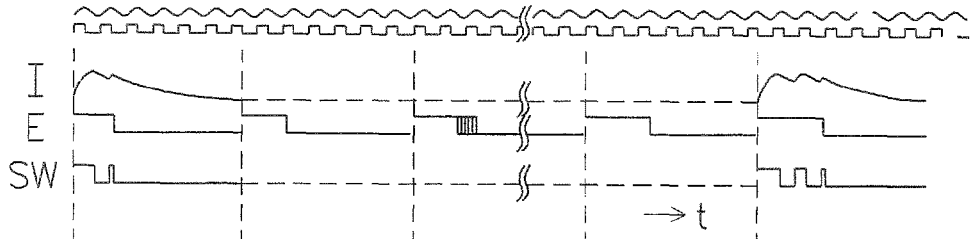
FIG. 25A-C depict time diagrams based on which an embodiment of the invention will be described.
Figure 25B:
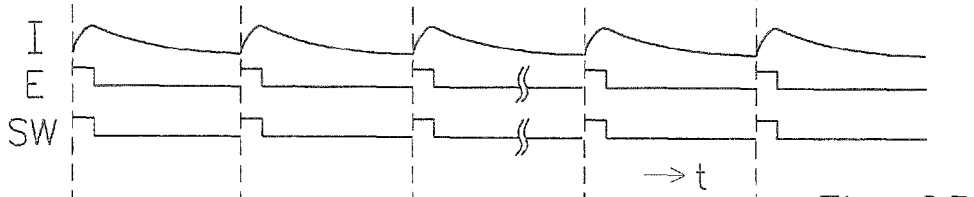
Figure 25C:
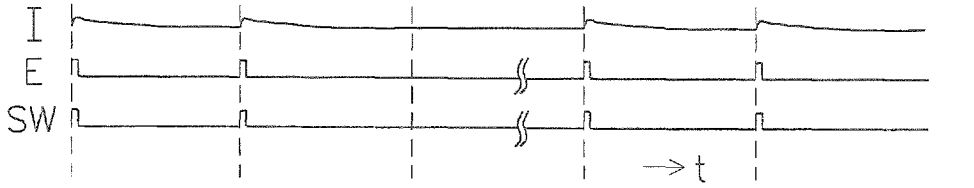

A further embodiment will be explained with reference to FIG. 25A-25C. In FIG. 25A-C, again time diagrams are shown of cycle parts. In this example a cycle is formed by 3326 microseconds (providing approximately 300 Hz cycle frequency) and the cycle is divided in 64 cycle parts. It is remarked that other cycle lengths and other divisions of the cycle in cycle time parts, e.g. in 128 cycle time parts, would be possible as well. In FIG. 25C, a situation is depicted wherein the switch SW of the converter is activated for a short time, namely in this example 0.125 microseconds by enable signal E that enables the converter. As a result, the current I exhibits a peak each time the comparator is enabled. Increasing an intensity, in FIG. 25B, the pulse length during which the current is enabled by E increases to 6.3 microseconds, which provides for a longer current pulse I and reaching a higher level. Hence, in the range of FIG. 25B to FIG. 25C, a relatively direct relation is found between the length of the enable pulse and the current level. A further increase of the enable pulse width E would however result in the comparator to switch to the state during which the switch is in the non-d conductive state. As a result, an increase of the pulse width of the enable signal E would not directly translate into an increase in the average current level, until the enable pulse width would be increased that much that the following switching cycle of the free running converter (e.g. the hysteretical converter) would start—at that moment the current would rise again causing a second peak in the same cycle time part, hence an increase in the average current. Hence, a gradual increase in the time during which the converter is enabled within each cycle would result in a rather stepwise increase in the current, hence in the intensity of the LED's. This effect may be at least partly avoided by applying a dithering or other variation to the enable pulse length: instead of a same pulse length in each cycle time part, the length is varied so as to arrive at an average corresponding to the desired cycle time. Therefore, in some of the cycle time parts, the enable time is longer than the average, and in others, the enable time is shorter. An example is illustrated in FIG. 25A. Here, in the first cycle time part, an enable pulse width E of 12 microseconds is applied. In the following cycle time parts, the pulse width is increased in steps of 0.125 microseconds to 20 microseconds. As depicted in FIG. 25A, the comparator and switch SW are activated slightly more than one cycle of the converter in the first cycle time part, while in the last cycle time part the comparator and switch SW of the converter are activated for slightly more than 2 cycles. As a result, the above described effect of a stepwise increase will play a role in some of the cycle time parts, while not playing a role in others. Therefore, an averaging takes place, which may result in a more smooth increase of the LED current and intensity with an increase in the average enable time of each cycle. Thereto, with each increase in intensity level, a an additional pulse may be added: the microprocessor (microcontroller) may for example start with providing a pulse in one of the cycle time parts of the cycle time, and add a pulse in another one of the cycle time part of the cycle time, for each next higher intensity level. The added pulses may be provided in a random one of the cycle time parts of the cycle time. Alternatively, they may be provided in a cycle time that is the most distant in time from the already present pulses: for example, in case of 64 cycle time parts in a cycle, and having started with a pulse in cycle part 1, the next pulse can be provided by the microprocessor in cycle part 33, as 33 is most distant from 1 in the same cycle time and from 1 in the next cycle time. Thereby, the likelihood that, if a pulse is at least partly in a "dead time", the one to be added next, will be in a "dead time" too, may be reduced, hence allowing a smooth and defined dimming behaviour. In order to take account of the "dead times" whereby the hysteretic converter is inactive by itself, a user set-point may need a recalculation: for very low intensities, (e.g. the case of FIGS. 25B and 25C, a small increase in pulse length or in the number of pulses, will result in a comparably larger increase in intensity, then a same increase in the situation in FIG. 25C, due to the dead times, which are to be taken account of in a calculation of the number of pulses to be added/removed, or the pulse lengths, in response to a changed (user) set-point. A large dimming range may further be obtained. For dimming below the intensities described with reference to FIGS. 25A-25C, the reference (e.g. reference voltage) may be reduced in value so as to reduce an amplitude of the remaining current peaks or pulses. The dimming as disclosed here may be described as the controller being arranged to provide enable pulses to enable the comparator in at least two cycle time parts of a cycle time, wherein a pulse length of the enable pulses is varied within each cycle time. The variation of the pulse length smoothens a level increase with increased average pulse length, as the effects of parts of the pulses being in "dead times" between successive active times of the hysteretical converter switching cycle, may be smoothened. The pulse lengths may be varied applying a linear, Gaussian, random or any other suitable distribution.

The dimming as described with reference to FIG. 25A-C may for example be applied in an LED driver comprising the free running converter as described above, however the application is not limited thereto. Rather, it may be applied in any other converter type too. The dimming may be implemented in the driver by e.g. a corresponding programming of the microprocessor MP or other microcontroller thereof. The dimming as described with reference to FIG. 25A-C may be applied for driving different Led groups, each group e.g. having a different colour, each group being e.g. switchable by means of parallel or serial switches so as to energize or de-energize the group. In case of for example 3 groups, in the situation where one or more of the groups is kept at a level below ⅓ of maximum, each such group is assigned its own time slot, and the dimming method as described above may then be applied for each of the groups in that specific slot. In case one of the groups is to be operated at an intensity between ⅓ and ⅔ of maximum, then the group is continuously powered in one of the time slots, and the dimming as specified above is applied in another one of the time slots so as to allow accurate and high resolution controlling of the intensity of the respective group. In addition to the schematic diagram as depicted in FIG. 23, use may be made of a voltage divider to lower a voltage over the LED's to a voltage within a range of measurement of the microprocessor (i.e. the controller). At low light intensities and lower current levels, this divider may have an effect on the effective current through the LED's, as a part of the current may then flow through the divider instead of through the LED's. Furthermore, the value of the resistive divider may have an effect on the decay of the pulse—i.e. the energy stored in the inductor. In an embodiment, a lower resistance value is chosen for the divider at low current values, to thereby provide a faster decay of the pulses at low current levels. At higher current values, a higher resistance value may be chosen (e.g. by suitable switching means under control of the microprocessor) for efficiency reasons.

Figure 26:
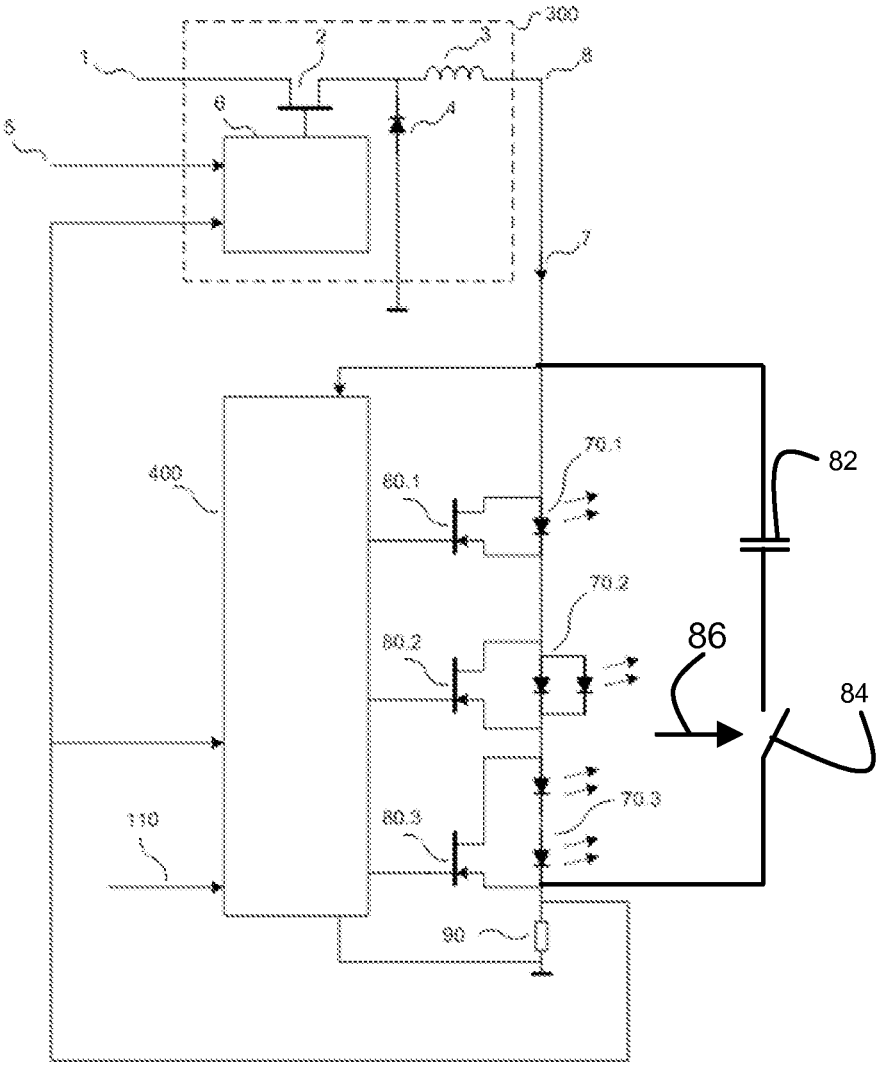
FIG. 26 schematically depicts an embodiment of a lighting system according to the third aspect of the invention.

In FIG. 26, an embodiment of a lighting system according to the present invention is depicted, comprising a control unit 400 arranged to control a switched mode power supply 300 and an LED assembly comprising three LED units 70.1, 70.2 and 70.3. The LED assembly further comprises switches (e.g. MOSFET's) 80.1, 80.2 and 80.3 associated with each LED unit for controlling the current per LED unit. In order to provide a desired output characteristic of the LED assembly, each of the LED units can be driven at a certain duty cycle. The LED assembly of the lighting system further comprises a capacitor 82 connectable in parallel to the LED units by closing a switch 84 which is connected in series with the capacitor. The application of the capacitor in parallel to the LED units enables to mitigate a current ripple occurring on the current supplied to the LED units since the capacitor operates as a buffer. When the LED units are to operate at a comparatively high current, the capacitor is preferably switched on, whereas the capacitor is preferably switched off at comparatively low current levels. The switch 84 (e.g. a MOSFET or the like) is controlled by the control unit 400 as indicated by signal 86. In accordance with the invention, the operating state of the switch is controlled (by the control unit 400) based upon the operating conditions or power requirements of the LED units. As such, the preferred operating state of the switch can e.g. be determined from the input signal 110 (which can e.g. represent a desired dimming level and thus a measure for the power requirements). As an alternative, the operating state of the switch can be based on the duty cycles applied and/or the current supplied to the LED units. The current as required for powering the LED units can be determined by the control unit 400 based on the input signal 110. Subsequently, the control unit 400 can provide a control signal to the power supply 300 (e.g. via an output port of the control unit) to control the power supply to provide the desired current. Similarly, the control unit can provide a control signal 86 (e.g. via the same output port) to control the switch 84. When a comparatively low power output is desired (e.g. dimming light conditions), it may be preferred to open the switch 84. By doing so, (e.g. when the LED units are to be supplied by a less than nominal current), losses occurring in the capacitor or the occurrence of peak currents or reduced current pulse edges can be avoided. The application of the switchable (or connectable) capacitor in parallel to the LED units is illustrated in FIG. 26 in a lighting system similar to the lighting system of FIG. 2. It is worth noting that a similar arrangement of a switchable capacitor may also be applied in other lighting systems, such as the systems illustrated in FIGS. 11 to 14.

As shown in the embodiment of FIG. 26, the capacitor 82 and switch 84 are connected in parallel to the LED units 70.1, 70.2 and 70.3 only and not in parallel to the resistance 90 of the LED assembly which can e.g. be applied as a feedback for the actual current 7 provided by the power supply. Such an arrangement has been found to provide a preferred current ripple reduction. It should however be noted that other configurations of the capacitor 82 and switch 84 in parallel to the LED units (e.g. a configuration whereby the capacitor 82 and switch 84 as shown are connected to ground, i.e. in parallel to the LED units and the resistance 90) could provide a current ripple reduction as well.

As shown, the LED assembly comprises a plurality of LED units 70.1, 70.2 and 70.3. In an embodiment, it may be considered to provide each LED unit with a separate capacitor connectable in parallel to the LED unit by operating a switch connected in series with the capacitor. As such, for each LED unit, it can be decided to either connect the respective capacitor in parallel or not, e.g. based on the duty cycle the LED unit is operated at.

Further, it can be noted that, in an embodiment, the control unit 400 can be arranged to apply the current duty cycling control as explained above, see e.g. FIGS. 15 and 16. When such current duty cycling is applied, i.e. controlling the power supply current provided to the LED unit or units to a first value in a first part of a cycle time and to a second value in a second part of the cycle time, the switch 84 can e.g. be controlled based on either the first or the second value or both. In case the first and second value of the power supply current are close together, the capacitor can be switched on or off during the entire cycle time. If there is a large difference however, it may be advantage to only connect the capacitor in parallel during that part of the cycle time when the largest current is provided. As such, the control of the switch 84 can also be based on the duty cycles of the first and second value of the power supply current as applied.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

A single processor or control unit may fulfil the functions of several items recited in the claims.

The invention claimed is:

1. A lighting system comprising:

a LED assembly that comprises a plurality of LED units, said LED units being serial connected;

a switched mode power supply for powering the LED assembly;

a control unit for controlling the LED assembly the control unit being arranged to:

receive an input signal representing a desired output characteristic of the LED assembly, determine a plurality of duty cycles for the respective plurality of LED units associated with a nominal current level of the switched mode power supply, for providing the desired output characteristic, determine the largest of the plurality of duty cycles for respective LED units, determine a current level that is reduced relative to the nominal current level based on at least the largest of the duty cycles, adjust the plurality of duty cycles for respective LED units based on the reduced current level or the largest of the duty cycles, and provide output data for the LED assembly and the switched mode power supply based on the adjusted plurality of duty cycles and the reduced current level, and wherein the LED assembly further comprises a capacitor connectable in parallel to the plurality of LED units by operating a switch connected in series with the capacitor and wherein the control unit is arranged to control the switch based on at least one of the reduced current and the input signal.

2. The lighting system according to claim 1 wherein the reduced current level substantially corresponds to the nominal current multiplied with the largest duty cycle.

3. The lighting system according to claim 1 wherein the reduced current level is based on a brightness characteristic of the LED units.

4. The lighting system according to claim 1 wherein the control unit comprises an input port for receiving the input signal.

5. The lighting system according to claim 1 wherein the control unit comprises an output port for providing the output data to the LED assembly and the switched mode power supply.

6. The lighting system according to claim 5 wherein the control unit is arranged to control the switch by providing a control signal to the switch via the output port.

7. The lighting system according to claim 1 wherein the control unit is arranged to control the switch based on the first and/or second duly cycle for respective LED units.

8. The lighting system according to claim 1 wherein the switched mode power supply comprises a resonant power converter.

9. A lighting system comprising:

an LED assembly comprising a first LED unit and a capacitor connectable in parallel to the first LED unit by operating a switch connected in series with the capacitor;

a switched mode power supply for, in use, powering the LED assembly, and a control unit comprising:

an input port for receiving an input signal;

an output port for providing a control signal to the switched mode power supply and the switch, the control unit being arranged to receive the input signal representing a desired output characteristic of the LED assembly, determine a power supply current for the switched mode power supply from the received input signal, provide, via the output port, the control signal to the switched mode power supply to control the switched mode power supply to provide the power supply current to the LED assembly; and provide, via the output port, a switch control signal to control the switch based on at least one of the power supply current and the input signal, and wherein said control unit further comprises a first LED control switch coupled to said first LED unit for controlling the current in said first LED unit said first LED control switch being operable independently of said switch connected in series with said capacitor.

10. The lighting system according to claim 9 wherein the control unit is further arranged to determine a first duty cycle for the first LED unit from the determined power supply current and the input signal, the combination of the first duty cycle and power supply current being set for providing the desired output characteristic, and provide, via the output port, the switch control signal to control the switch based on the first duty cycle.

11. The lighting system according to claim 9 wherein the LED assembly further comprises a second LED unit; wherein the capacitor is connectable in parallel to the first and second LED units by operating the switch.

12. The lighting system according to claim 11 wherein the control unit is further arranged to determine a first duty cycle for the first LED unit from the determined power supply current and the input signal, determine a second duty cycle for the second LED unit from the determined power supply current and the input signal, the combination of first and second duty cycle and power supply current being set for providing the desired output characteristic, and provide, via the output port, a switch control signal to control the switch based on the first and/or second duty cycles.

13. The lighting system according to claim 11 wherein the first and second LED units are connected in series.

14. The lighting system according to claim 9, wherein said control unit further comprises a second LED unit and a second LED control switch, each said LED control switch being coupled to a respective one of said first and second LED units for controlling the current in each LED unit, said LED control switches being operable independently of said switch connected in series with said capacitor.

15. The lighting system according to claim 9, wherein said control unit is operative to close said switch connected in series with said capacitor when the reduced current level is above a predetermined level.

16. The lighting system according to claim 9, wherein said control unit is operative to open said switch connected in series with said capacitor when the reduced current level is below a predetermined level.

* * * * *